US006729272B2

(12) United States Patent
Iizuka et al.

(10) Patent No.: US 6,729,272 B2
(45) Date of Patent: May 4, 2004

(54) CYLINDER HEAD COOLING CONSTRUCTION FOR AN INTERNAL COMBUSTION ENGINE

(75) Inventors: Yoshiaki Iizuka, Saitama (JP); Makoto Suzuki, Saitama (JP); Kiyoshi Takagi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 89 days.

(21) Appl. No.: 10/146,043

(22) Filed: May 16, 2002

(65) Prior Publication Data

US 2002/0170510 A1 Nov. 21, 2002

(30) Foreign Application Priority Data

May 17, 2001 (JP) ..... P. 2001-148335

(51) Int. Cl.[7] ..... F02F 1/40; F01P 3/02; F01P 7/16

(52) U.S. Cl. ..... 123/41.84; 123/41.79

(58) Field of Search ..... 123/41.79, 41.84, 123/41.01, 41.31

(56) References Cited

U.S. PATENT DOCUMENTS

| | | | | |
|---|---|---|---|---|
| 4,660,527 A | | 4/1987 | Tanaka et al. | |
| 4,889,079 A | | 12/1989 | Takeda et al. | |
| 4,957,068 A | | 9/1990 | Wagner et al. | |
| 5,080,049 A | * | 1/1992 | Solomon et al. | 123/41.79 |
| 5,150,668 A | * | 9/1992 | Bock | 123/41.84 |
| 5,189,992 A | * | 3/1993 | Hama et al. | 123/41.84 |
| 5,207,189 A | * | 5/1993 | Kawauchi et al. | 123/41.84 |
| 5,251,578 A | * | 10/1993 | Kawauchi et al. | 123/41.84 |
| 5,537,969 A | * | 7/1996 | Hata et al. | 123/41.84 |
| 5,799,627 A | | 9/1998 | Dohn et al. | |
| 6,123,052 A | * | 9/2000 | Jahn | 123/41.84 |
| 6,418,886 B1 | * | 7/2002 | Haimerl et al. | 123/41.79 |

FOREIGN PATENT DOCUMENTS

| | | |
|---|---|---|
| DE | 41 00 459 A1 | 8/1991 |
| EP | 0 816 661 A1 | 1/1998 |
| JP | 11-117803 | 4/1999 |

* cited by examiner

*Primary Examiner*—Henry C. Yuen
*Assistant Examiner*—J. Benton
(74) *Attorney, Agent, or Firm*—Arent Fox Kintner Plotkin & Kahn

(57) ABSTRACT

Deflecting ribs are provided within a coolant jacket formed in a cylinder head in such a manner as to protrude upwardly from bottom walls for directing the flow of coolant toward exhaust-valve-port side port wall portions The deflecting ribs for deflecting part of the flow of coolant toward the exhaust-valve-port side port wall portions are formed in such a manner as to extend from the intake-valve-port side port wall portions, and gaps are left between the exhaust-valve-port side port wall portions and the deflecting ribs for allowing the coolant to flow along the wall surfaces of the exhaust-valve-port side port wall portions, whereby there is generated no stagnation of the coolant on the wall surfaces of the exhaust-valve-port side port wall portions at the portions where the gaps are formed.

8 Claims, 10 Drawing Sheets

CYLINDER HEAD COOLING CONSTRUCTION FOR AN INTERNAL COMBUSTION ENGINE

BACKGROUND OF THE INVENTION

1. Field of the Invention

The present invention relates to the construction of a cooling water or coolant jacket formed in a cylinder head of a water-cooled internal combustion engine.

2. Description of the Related Art

Conventionally, known as a cylinder head of a water-cooled internal combustion engine of this type is a cylinder head construction of an internal combustion engine disclosed by JP-A-11-117803. In this cylinder head construction, a rib is provided between adjacent cylinders which connects a circumferential edge portion of an intake valve port of one of the cylinders and a circumferential edge portion of an exhaust valve port of the other cylinder. The rib, which is formed on an upper surface of a lower deck which constitutes a bottom of a coolant jacket in such a manner as to have an angle section, connects to the circumferential edge portion of the inlet valve port on an upstream side of the flow direction of coolant flowing between the cylinders and the circumferential edge portion of the exhaust valve port on a downstream side thereof. Then, the rib so formed deflects the flow direction of the coolant to guide the coolant between circumferential edge portions of a pair of exhaust valve ports so as to attain the cooling of vicinities of the same portions.

Incidentally, in the related art, since the rib formed in such a manner as to protrude from the upper surface of the lower deck connects the circumferential edge portion of the inlet valve port and the circumferential edge portion of the exhaust valve port, there occurs on the back of the rib stagnation in the flow of coolant relative to the flow direction of coolant which flows against the rib on the upper surface of the lower deck and the surface of the circumferential portion of the exhaust valve port, whereby there is caused a problem that the cooling effect becomes deteriorated on the lower deck and the circumferential edge portion of the exhaust valve port which are particularly heated to high temperatures due to the exposure to combustion gases.

SUMMARY OF THE INVENTION

The invention was made in view of these situations, and a common object of first to fourth aspects of the invention is to improve the cooling effect of a coolant jacket of an internal combustion engine which has deflecting ribs for directing coolant to exhaust-valve-port side port wall portions whose heat load is high by reducing areas where the stagnation of coolant occurs by the deflecting ribs. Then, an object of the second and fourth aspects of the invention is to improve the cooling effect by preventing the occurrence of the stagnation at the port wall portion on the exhaust-valve-port side. Furthermore, an object of the third aspect of the invention is to improve the rigidity of the cylinder head.

According to the first aspect of the invention, there is provided a cylinder head cooling construction for an internal combustion engine with cylinders and a crankshaft in which a coolant jacket through which coolant is allowed to flow is formed by cylinder walls including bottom walls forming chamber walls of combustion chambers, intake port walls forming intake ports having intake valve ports which are opened and closed by intake valves and exhaust port walls forming exhaust ports having exhaust valve ports which are opened and closed by exhaust valves, and in which deflecting ribs are formed in the coolant jacket between intake-valve-port side port wall portions and exhaust-valve-port side port wall portions which are situated downstream of the intake-valve-port side port wall portions in a flow direction of the coolant in such a manner as to protrude upwardly from the bottom walls for directing the flow of coolant toward the exhaust-valve-port side port wall portions, the cylinder head cooling construction being characterized in that the deflecting ribs for deflecting part of the flow of coolant which flows in a cylinder head center line direction toward the exhaust-valve-port side port wall portions between the intake-valve-port side port wall portions and the exhaust-valve-port side port wall portions are formed such that the deflecting ribs leave gaps between at least either the intake-valve-port side port wall portions or the exhaust-valve-port side port wall portions and the deflecting ribs or that the deflecting ribs extend from the intake-valve-port side port wall portions and the exhaust-valve-port side port wall portions to leave gaps at intermediate positions thereof for allowing the coolant to flow wall surfaces of the bottom walls, wall surfaces of the intake-valve-port side port wall portions, or wall surfaces of the exhaust-valve-port side port wall portions.

According to the construction of the first aspect of the invention, since the deflecting ribs which protrude upwardly from the bottom walls are formed such that the deflecting ribs leave gaps between at least either the intake-valve-port side port wall portions or the exhaust-valve-port side port wall portions and the deflecting ribs or that the deflecting ribs extend from the intake-valve-port side port wall portions and the exhaust-valve-port side port wall portions to leave gaps at intermediate positions thereof for allowing the coolant to flow wall surfaces of the bottom walls, wall surfaces of the intake-valve-port side port wall portions, or wall surfaces of the exhaust-valve-port side port wall portions, the gaps eliminate any risk that the coolant stagnates on the wall surfaces of the bottom walls forming the chamber walls of the combustion chambers, the wall surfaces of the intake-valve-port side port wall portions or the wall surfaces of the exhaust-valve-port side port wall portions. As a result, the following advantage is provided. Namely, since part of the coolant is deflected to flow toward the exhaust-valve-port side port wall portions which have the highest heat load among the walls of the cylinder head which constitute the coolant jacket, the cooling effect on the exhaust-valve-port side port wall portions is improved. Moreover, being different from the continuous ribs according to the prior art, the coolant flowing through the gaps eliminates the occurrence of stagnation of coolant on the wall surfaces of the bottom walls, the wall surfaces of the intake-valve-port side port wall portions and the wall surfaces of the exhaust-valve-port side port wall portions at the portions where the gaps are formed. Furthermore, part of the coolant flowing in from the gaps flows around to the back of the deflecting ribs, and this reduces further areas where the stagnation in the flow of coolant is generate, whereby the areas where the coolant stagnates due to the deflecting ribs are reduced, the cooling effect on the bottom walls, the intake-valve-port side port wall portions or the exhaust-valve-port side port wall portion being thereby improved.

According to the second aspect of the invention, there is provided a cylinder head cooling construction for an internal combustion engine as set forth in the first aspect of the invention, wherein the deflecting ribs are formed to extend from the intake-valve-port side port wall portions, and wherein the gaps are designed to allow the coolant to flow on the wall surfaces of the exhaust-valve-port side port wall portions between the exhaust-valve-port side port wall portions and the deflecting ribs.

According to the construction of the second aspect of the invention, the following advantage is provided. Namely, since the gaps are formed between the exhaust-valve-port side port wall portions and the deflecting ribs, part of the coolant is deflected to flow toward the exhaust-valve-port side port wall portions which have the highest heat load among the walls of the cylinder head which constitute the coolant jacket, whereby the cooling effect on the exhaust-valve-port side port wall portions is improved. Moreover, being different from the continuous ribs according to the prior art, the coolant flowing through the gaps eliminates the occurrence of stagnation of coolant on the wall surfaces of the exhaust-valve-port side port wall portions at the portions where the gaps are formed. Furthermore, part of the coolant flowing in from the gaps flows around to the back of the deflecting ribs, and this reduces further areas where the stagnation in the flow of coolant is generate, whereby the areas where the coolant stagnates due to the deflecting ribs are reduced, the cooling effect on the exhaust-valve-port side port wall portion being thereby improved. Thus, the portions having a high heat load can be cooled effectively.

According to the third aspect of the invention, there is provided a cylinder head cooling construction for an internal combustion engine as set forth in the first or second aspect of the invention, wherein the internal combustion engine is a multi-cylinder internal combustion engine, wherein the deflecting rib is formed between the intake-valve-port side port wall portion of one of two cylinders of said cylinders which are contiguous with each other in the cylinder head center line direction and the exhaust-valve-port side port wall portion of the other cylinder, and wherein the deflecting ribs protrude upwardly from the bottom wall to connect to a central rib which extend in the cylinder head center line direction between end portions of the cylinder head.

According to the construction of the third aspect of the invention, in addition to the advantages provided by the cited aspects of the invention, the following advantage is provided. Namely, since the central rib is provided on the bottom wall of the cylinder head which protrudes upwardly from the bottom wall and extends in the cylinder head center line direction between the end portions of the cylinder head, the coolant which flows between the intake-valve-port side port wall portions and the exhaust-valve-port side port wall portions of the cylinder head is straightened along the cylinder head center line direction to flow to the downstream side, whereby the chamber wall of the combustion chamber, the intake-valve-port side port wall portion and the exhaust-valve-port side port wall portion of each cylinder can be cooled substantially equally with the coolant so flowing. In addition, the provision of the central rib and the deflecting ribs which connect to the central rib can contribute to making the entirety of the cylinder head more rigid.

According to the fourth aspect of the invention, there is provided a cylinder head cooling construction for an internal combustion engine with cylinders and a crankshaft in which a coolant jacket through which coolant is allowed to flow is formed by cylinder walls including bottom walls forming chamber walls of combustion chambers, upper walls, intake port walls forming intake ports having intake valve ports which are opened and closed by intake valves and exhaust port walls forming exhaust ports having exhaust valve ports which are opened and closed by exhaust valves, and in which deflecting ribs are formed in the coolant jacket between intake-valve-port side port wall portions and exhaust-valve-port side port wall portions which are situated downstream of the intake-valve-port side port wall portions in a flow direction of the coolant in such a manner as to protrude upwardly from the bottom walls for directing the flow of coolant toward the exhaust-valve-port side port wall portions, the cylinder head cooling construction being characterized in that the deflecting ribs for deflecting part of the flow of coolant which flows in a cylinder head center line direction toward the exhaust-valve-port side port wall portions between the intake-valve-port side port wall portions and the exhaust-valve-port side port wall portions are formed such that the deflecting ribs extend downwardly from the upper walls and extend toward the intake-valve-port side port wall portions and the exhaust-valve-port side port wall portions to leave gaps between lower end portions of the deflecting ribs and the exhaust-valve-port side port wall portions and the bottom walls for allowing the coolant to flow on wall surfaces of the exhaust-valve-port side port wall portions and wall surfaces of the bottom walls.

According to the construction of the fourth aspect of the invention, the following advantage is provided. Namely, since the lower end portions of the deflecting ribs which protrude downwardly from the upper walls form the gaps between the exhaust-valve-port side port wall portions and the bottom walls and themselves for allowing the coolant to flow on the respective wall surfaces of the bottom walls and the exhaust-valve-port side port wall portions, there is no risk that the coolant stagnates on the respective wall surfaces of the bottom walls that form the chamber walls of the combustion chambers and the exhaust-valve-port side port wall portions. As a result, the following advantage is provided in turn. Namely, since part of the coolant is deflected to flow toward the exhaust-valve-port side port wall portions which have the highest heat load among the walls of the cylinder head which constitute the coolant jacket, the cooling effect on the exhaust-valve-port side port wall portions is improved. Moreover, the coolant flowing through the gaps eliminates the occurrence of stagnation of coolant on the wall surfaces of the bottom walls and the wall surfaces of the exhaust-valve-port side port wall portions at the portions where the gaps are formed, whereby the areas where the coolant stagnates due to the deflecting ribs are reduced, the cooling effect on the bottom walls and the exhaust-valve-port side port wall portion being thereby improved. Thus, the portions having a high heat load can be cooled effectively.

Note that as used herein, the term "viewed from the top" means viewing from a centrally axial direction of a cylinder bore, and the terms "intake-valve-port side port wall portion" and "exhaust-valve-port side port wall portion" mean, respectively, an intake-port wall and an exhaust-port wall which are included within the range of the cylinder bore as viewed from the top. In addition, the term "cylinder-head center line" means a straight line in the cylinder head when viewing from the centrally axial direction of the cylinder, an imaginary plane including central axes of the cylinder bores and the rotational axis of the crankshaft or an imaginary plane including the central axes of the cylinder bores and being parallel to the rotational axis of the crankshaft. Additionally, the terms "intake side" and "exhaust side" mean, respectively, a side of the cylinder head where inlet ports for the intake ports are situated and the other side of the cylinder where outlet ports for the exhaust ports are situated, relative to the imaginary planes.

DETAILED DESCRIPTION OF THE PREFERRED EMBODIMENTS

Figure 1:
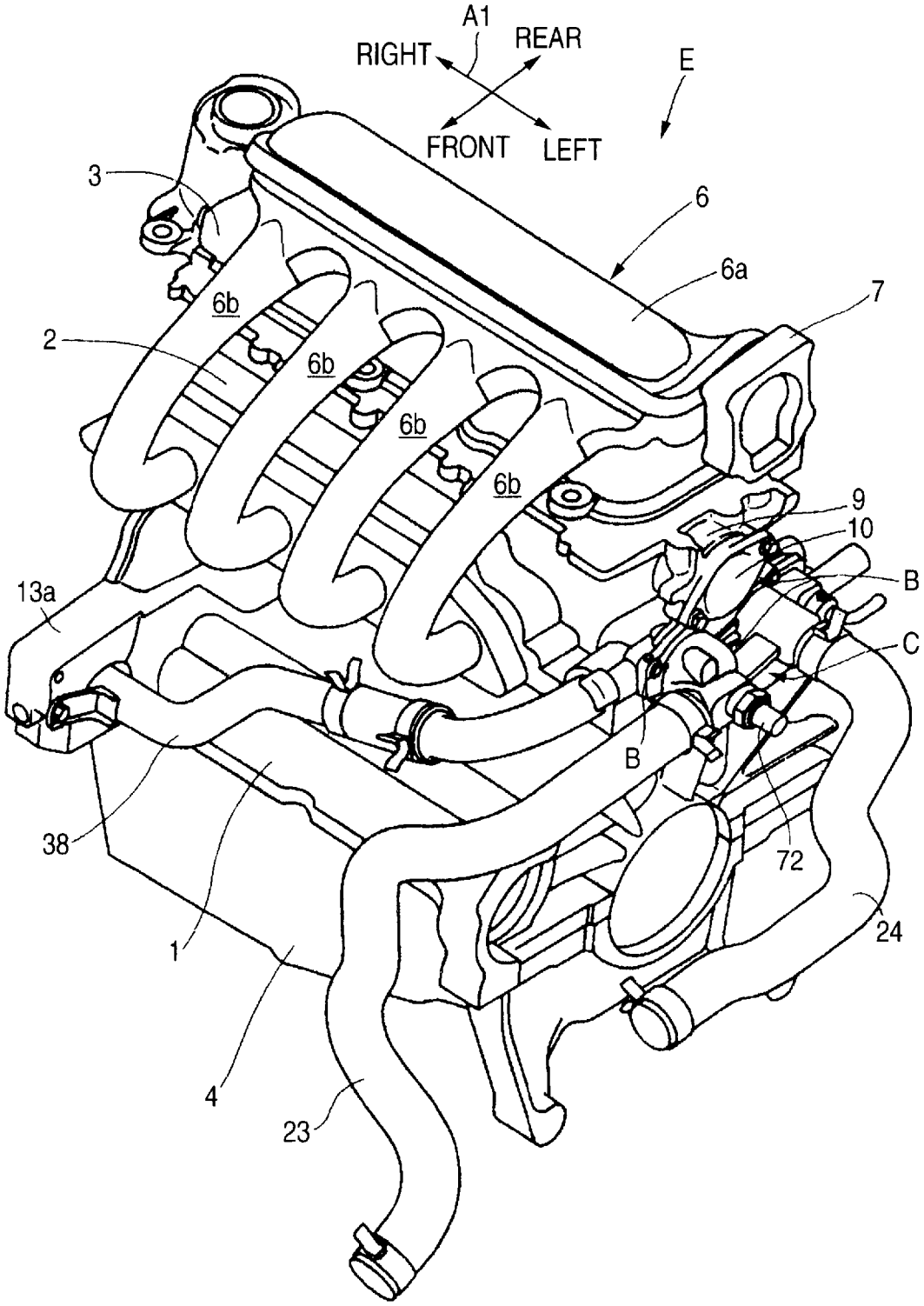
FIG. 1 is a schematic perspective view of an internal combustion engine according to a first embodiment of the invention.

Embodiments of the invention will be described below with reference to FIGS. 1 to 10.

FIGS. 1 to 8 show a first embodiment of the invention. Firstly, referring to FIG. 1, an internal combustion engine E to which a cylinder head according to the invention is applied is an overhead cam, water-cooled, four-cylinder, four-cycle internal combustion engine which is installed in a vehicle with a crankshaft being directed in a transverse direction.

Note that when a term "longitudinally and transversely" is used in this embodiment, it means "longitudinally and transversely" of a vehicle to which a reference is made.

The internal combustion engine E comprises a cylinder block 1 in which first to fourth cylinders $\mathbf{5}_1$ to $\mathbf{5}_4$ (refer to FIG. 2) are arranged in series which cylinders have cylinder bores 5*a* in which pistons are fitted slidably (refer to FIG. 3), a cylinder head 2 joined to an upper end of the cylinder block 1, a cylinder-head cover 3 joined to an upper end of the cylinder head 2, and an oil pan 4 jointed to a lower end of the cylinder block 1, and a main body of the internal combustion engine E is constituted by the cylinder block 1, the cylinder head 2, the cylinder-head cover 3 and the oil pan 4.

Then, an intake manifold 6 is mounted on a front 2*a* of the cylinder head 2 which is an intake side thereof. The intake manifold 6 has a collecting tube 6*a* which is situated directly over the cylinder-head cover 3 and at a left end portion of which a throttle body 7 is provided, and four branch pipes 6*b* which are branched from the collecting tube 6*a* for connection to the front side 2*a* of the cylinder head. The respective branch pipes 6*a* communicate with combustion chambers $\mathbf{8}_1$ to $\mathbf{8}_4$ (refer to FIG. 2) of the respective cylinders $\mathbf{5}_1$ to $\mathbf{5}_4$ via intake ports 40 (refer to FIG. 3) formed in the cylinder head 2. Note that an exhaust manifold (not shown) is mounted on a rear side 2*b* (refer to FIG. 3) of the cylinder head 2 which is an exhaust side thereof.

A cam cover 10 is attached to a left end portion of the cylinder head 2 which is one end portion of the cylinder head 2 in a cylinder head center line direction A1 (which coincides with a direction in which the first to fourth cylinders $\mathbf{5}_1$ to $\mathbf{5}_4$ are arranged, and also coincides with the transverse direction in this embodiment) for covering an opening in a cylindrical protruding portion 9 formed as an axial extension to a camshaft (not shown) disposed within a valve train chamber V (refer to FIG. 4) formed by the cylinder head and the cylinder-head cover 3 so as to be rotatably supported on the cylinder head 2. In addition, although not shown, a power transmission mechanism for rotationally driving the camshaft with power from the crankshaft is provided at a right end portion of the cylinder block 1 and the cylinder head 2 which is the other end portion thereof in the cylinder head center line direction A1, and a cover for covering the power transmission mechanism is attached to right end faces of the cylinder block 1 and the cylinder head 2.

Next, mainly referring to FIG. 2, a cooling system for the internal combustion engine E will be described. A coolant circulating pump 13 having a pump body 13*a* (refer to FIG. 1) which is formed integrally with the cylinder block 1 at the right end portion and the front side thereof where a block-side coolant jacket 11 is formed in the cylinder block 1. In addition, a thermostat 15 is provided on the cylinder head 2 in which a head-side coolant jacket 12 is formed in such a manner as to be accommodated in an accommodating chamber 14 which is formed at the left-end portion of the cylinder head 2. Furthermore, the two jackets 11, 12 are made to communicate with each other via a number of communicating paths 16 formed in the cylinder head 2.

A thermostat cover C is mounted on one side or the left end face of the cylinder head 2, and an inlet passage 20 and two outlet passages 21, 22 are formed in the thermostat cover C. Then, the thermostat 15 communicates with a radiator 25 via the inlet passage 20 and a radiator hose 23, and a passage 26 formed in the cylinder head 2 communicates with the radiator 25 via the outlet passage 21 and a radiator hose 24. In addition, the coolant jacket 12 communicates with a heater core 29 for air conditioning via the outlet passage 22 and a hose 27 whereas it communicates with a coolant passage formed in the throttle body 7 via the outlet passage 22 and a hose 30. Furthermore, a return port 32 formed in the cylinder head 2 and an opening 33 formed in a pipe 38, which will be described later, are connected to the heater core 29 and the coolant passage in the throttle body 7 via a hose 28 and a hose 31, respectively. Here, the respective hoses 23, 24, 27, 28, 30, 31 constitute coolant passage forming members.

Then, coolant discharged from the coolant circulating pump 13 flows into the coolant jacket 12 from an inlet port 35 formed in the cylinder head 2 via discharge passage 34 formed in the cylinder block 1. When the internal combustion engine E is in cool operating conditions, since the thermostat 15 cuts the communication between the radiator hose 23 and the accommodating chamber 14, as shown by broken lines in the figure, there is little coolant which flows into the coolant jacket 11 through the communicating path 16, and the coolant in the coolant jacket 12 flows into the accommodating chamber 14 through a by-pass passage 36 formed in the cylinder head 2, while part thereof is supplied to the heater core 29 after flowing through the hose 27 for exchanging heat with air for heating the interior of the passenger compartment. After the heat in the coolant has been transferred the air, the coolant returns to the accommodating chamber 14 via the hose 28 and the return port 32. Furthermore, another part of the coolant in the coolant jacket 12 is supplied to the throttle body 7 after flowing through the hose 30 for heating the throttle body 7 when the engine is not warmed up, and thereafter, the coolant flows into the pipe 38 after flowing through the hose 31. In addition, since the coolant in the accommodating chamber 14 is drawn into the coolant circulating pump 13 via the pipe 38 connecting to an inlet port 37 formed in the cylinder head 2 in such a manner as to open to the accommodating chamber 14, when the engine is in cool operating conditions, the coolant flows through the coolant jacket 12 without flowing through the radiator 25.

In addition, when the internal combustion engine E is in hot operating conditions, since the thermostat 15 establishes a communication between the radiator hose 23 and the accommodating chamber 14 and at the same time shuts the by-pass passage 36, the coolant in the cooling jacket 12 flows into the coolant jacket 11 through the communicating path 16, as indicated by solid lines in the figure, to cool the cylinder block 1 without flowing into the accommodating chamber 14 through the by-pass passage 36. Thereafter, the coolant flows into the radiator 25 via a passage 39 formed in the cylinder block 39 and through the outlet passage 21 and the radiator hose 24. Then, after the temperature thereof is lowered after dissipation of heat in the radiator 25, the coolant flows into the accommodating chamber 14 through the radiator hose 23 via the inlet passage 20 and the thermostat 15. As this occurs, part of the coolant in the coolant jacket 12 is, as when the engine is in cool operating conditions, supplied to the heater core 29 where heat is transferred to air therein and then returns to the accommodating chamber 14. Additionally, the coolant which is supplied to the throttle body 7 is controlled with respect to the flow rate thereof by a control valve (not shown) for preventing the excessive heating of the throttle body 7. Then, the coolant in the accommodating chamber 14 is drawn into the coolant circulating pump 13 via the outlet port 37 and the pipe 38, and when the engine is in hot operating conditions, the coolant that has passed through the radiator 25 flows through the two coolant jackets 11, 12.

Next, referring to FIGS. 3, 4, the construction of the cylinder head 2 will be described. Note that in FIG. 3, the cross sections of an intake port 40 and an exhaust port 41 of the third cylinder $\mathbf{5}_3$ are different from those of the remaining cylinders $\mathbf{5}_1$, $\mathbf{5}_2$, $\mathbf{5}_4$, to show the cross sections thereof which are closer to a combustion chamber $\mathbf{8}_3$.

In the cylinder head 2, combustion chambers $\mathbf{8}_1$ to $\mathbf{8}_4$ (refer to FIGS. 2, 4) are formed in such a manner as to correspond to the first to fourth cylinders $\mathbf{5}_1$ to $\mathbf{5}_4$ in the cylinder block 1, and there are provided an intake port 40 and an exhaust port 41 for each combustion chamber in such a manner as to communicate with the combustion chambers $\mathbf{8}_1$ to $\mathbf{8}_4$, respectively. Each intake port 40 has an intake valve port 40*a* which is made to open to each of the combustion chambers $\mathbf{8}_1$ to $\mathbf{8}_4$ and is opened and closed by an intake valve (not shown) and an inlet port 40*b* which is made to open to the front side 2*a* of the cylinder head 2 and to which the branch pipe 6*b* of the intake manifold 6 is connected. On the other hand, each exhaust port 41 has an exhaust valve port 41*a* which is made to open to each of the combustion chambers $\mathbf{8}_1$ to $\mathbf{8}_4$, and is opened and closed by an exhaust valve 42 (refer to FIG. 4) and an outlet port 40*b* which is made to open to the rear side 2*b* of the cylinder head 2 and to which the exhaust manifold is connected.

Furthermore, formed in the cylinder head 2 in such a manner as to be contiguous with the intake port 40 and the exhaust port 41, respectively, are two mount portions 43, 44 each having insertion holes 43*a*, 44*a* into which two sparking plugs (not shown) facing each of the combustion chambers $\mathbf{8}_1$ to $\mathbf{8}_4$ are inserted. Then, as shown in FIG. 3, the mount portion 43 and the intake port 40 are disposed in that order for each combustion chamber $\mathbf{8}_1$ to $\mathbf{8}_4$ from the other end portion or the right-end portion (situated on the left end as viewed in FIG. 3) of the cylinder head 2 in the cylinder-head center direction A1 on the intake side thereof, whereas the exhaust port 41 and the mount portion 44 are disposed in that order from the right end of the cylinder head 2 on the exhaust side thereof.

Figure 4:
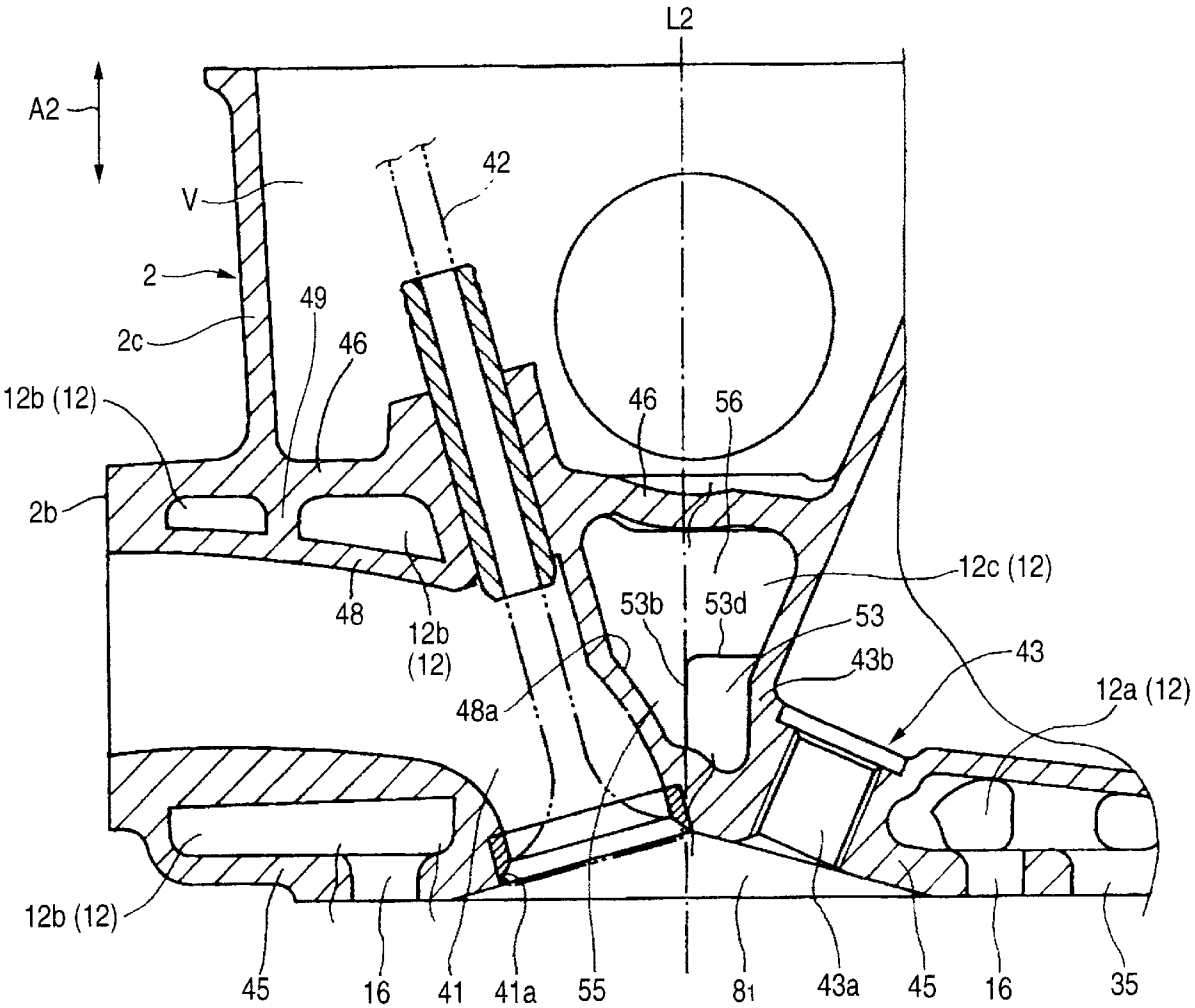
FIG. 4 is a sectional view taken along the line IV—IV in FIG. 3.

Referring also to FIG. 4, the coolant jacket 12 is constituted by a bottom wall 45 which forms a chamber wall of the combustion chamber $\mathbf{8}_1$ to $\mathbf{8}_4$, an upper wall 46 which forms a chamber wall of a valve train chamber V in which a valve train (not shown) constituted by the camshaft and the like for driving the intake valve and the exhaust valve 42 is accommodated, a port wall 47 which forms the intake port 40, a port wall 48 which forms the exhaust port 41 and a wall of the cylinder head 2 which includes walls 43*b*, 44*b* of the mount portions 43, 44 for the two sparking plugs. Then, the coolant jacket 12 comprises an intake-side jacket portion 12*a*, an exhaust-side jacket portion 12*b* and a central jacket portion 12*c*. The intake-side jacket portion 12*a* is situated on the intake side of the cylinder head 2 and extends between the left and right end portions of the cylinder head 12 along the cylinder-head center line Al at a position closer to the inlet port 40*b* of the intake port 40 than the combustion chamber $\mathbf{8}_1$ to $\mathbf{8}_4$. The exhaust-side jacket portion 12*b* is situated on the exhaust side of the cylinder head and extends between the left and right end portions of the cylinder head 12 along the cylinder-head center line Al at a position closer to the outlet port 41*b* of the intake port 41 than the combustion chamber $\mathbf{8}_1$ to $\mathbf{8}_4$. The central jacket portion 12*c* extends on the cylinder-head center ling L1 between the left and right end portions of the cylinder head 2 directly on the combustion chamber $\mathbf{8}_1$ to $\mathbf{8}_4$. The central jacket portion 12*c* and the intake-side and exhaust-side jacket portions 12*a*, 12*b* are made to communicate with each other between the adjacent combustion chambers $\mathbf{8}_1$, $\mathbf{8}_2$; $\mathbf{8}_2$, $\mathbf{8}_3$; $\mathbf{8}_3$, $\mathbf{8}_4$ as viewed from the top. Furthermore, at the right end portion of the cylinder head 2, the central jacket portion 12*c* and the intake-side and exhaust-side jacket portions 12*a*, 12*b* are made to communicate with each other via a communicating portion 12*d*.

Then, as shown in FIG. 4, an intake side jacket portion 12*a* is formed on a bottom wall 45 side of each intake port 40 but is not formed on an upper wall 46 side, whereas exhaust side jacket portions 12*b* are formed on a bottom wall 45 side and an upper wall 46 side of each exhaust port 41 and between adjacent exhaust ports 41 in such a manner as to surround the circumference of each exhaust port 41. In the exhaust side jacket portion 12*b*, a rib 49 for connecting a port wall 48 and the upper wall 46 of each exhaust port 41 is formed integrally with the walls 48, 46 on an extension in a centrally axial direction A2 of a side wall 2*c* on the exhaust side of the valve train chamber V which is formed along the center line direction A1 of the cylinder head. Four ribs 49 provided correspondingly to the four exhaust ports 41 each have a flat oval horizontal cross section along the cylinder head center line direction A1 and are disposed on a straight line which is parallel to the cylinder head center line L1 at certain intervals in the cylinder head center line direction A1.

Figure 2:
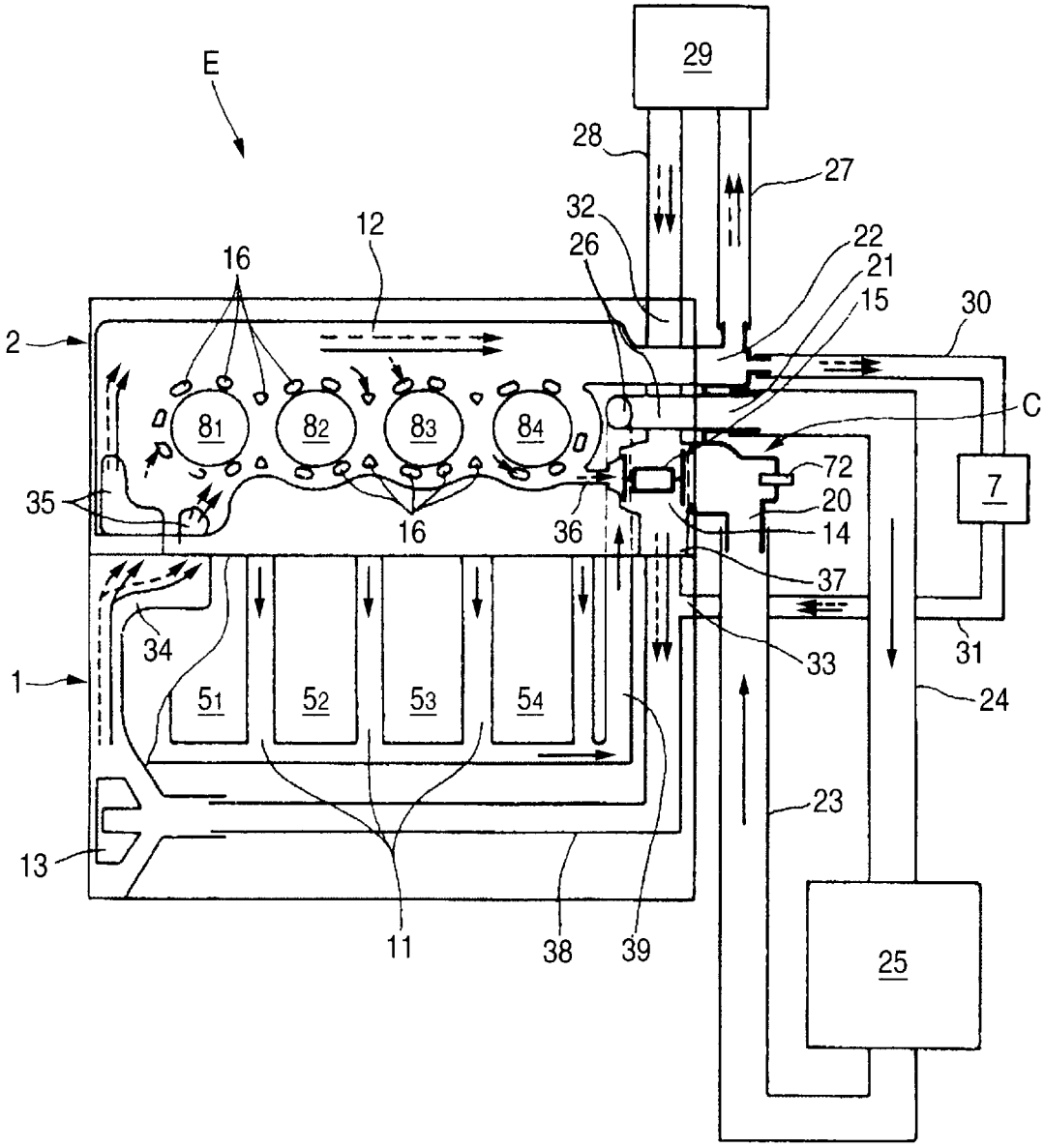
FIG. 2 is an exemplary view of a cooling system for the internal combustion engine in FIG. 1.
Figure 3:
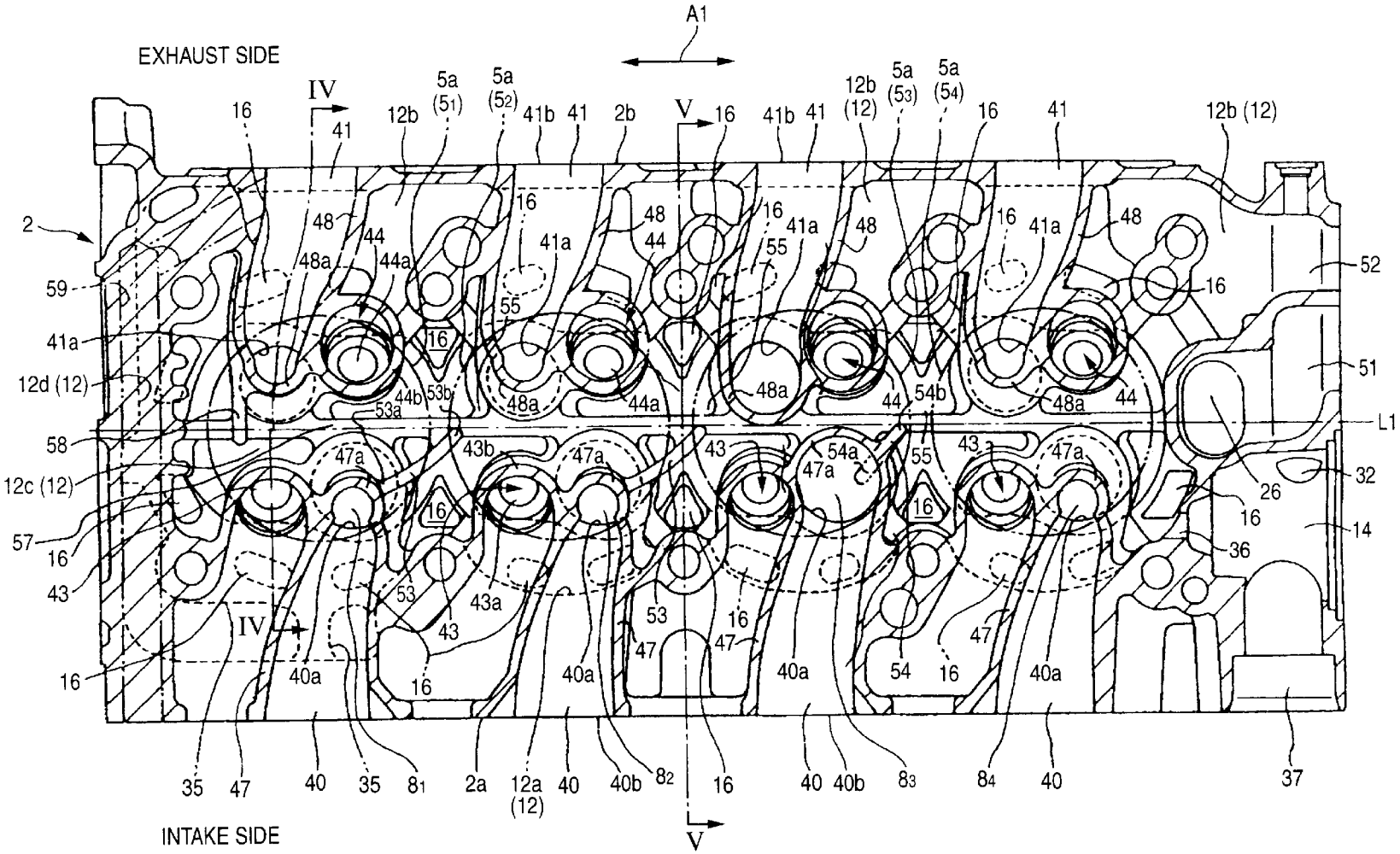
FIG. 3 is a plan view of a cylinder head of the internal combustion engine shown in FIG. 1.

In addition, as shown in FIG. 3, on the intake-side of the right-end portion of the cylinder head 2, the inlet port 35 which communicates with the discharge passage 34 (refer to FIG. 2) at a connecting surface to the cylinder block 1 is formed in such a manner as to open to the intake-side jacket portion 12*a* in the vicinity of the front end portion and the right-end portion of the intake-side jacket portion 12*a*. Additionally, on the intake-side of the left-end portion of the cylinder head 2, the accommodating chamber 14 of the thermostat 15 communicates with the intake-side jacket portion 12*a* via the by-pass passage 36, an outlet port 52 communicating with the hose 27 connected to the heater core 29 is formed to open to the exhaust-side jacket portion 12*b* in the cylinder-head center line direction A1 at the rear-end portion and the left-end portion of the exhaust-side jacket portion 12*b*. Furthermore, an outlet port 51 which communicates with the coolant jacket 11 via the passages 39, 26, as well as the radiator 25 via the radiator hose 24 is formed between the accommodating chamber 14 and the outlet port 52 in a direction normal to the cylinder-head center line direction A1 (hereinafter, referred to as a "normal direction") as viewed from the top. Then, at the left-end portion of the cylinder head 2, an outlet port 37 to which the pipe 38 communicating with the coolant circulating pump 13 is connected is made to open to the front side 2*a* of the cylinder head 2 whereas the return port 32 to which the hose 28 connected to the heater core 29 is connected is made to communicate with the rear side 2*b* thereof. Furthermore, a number of communicating passages 16 are formed around the respective combustion chambers $\mathbf{8}_1$ to $\mathbf{8}_4$ in circumferential directions thereof at certain intervals for supplying coolant discharged from the coolant circulating pump 13 to the coolant jacket 11 via the coolant jacket 12.

Figure 5:
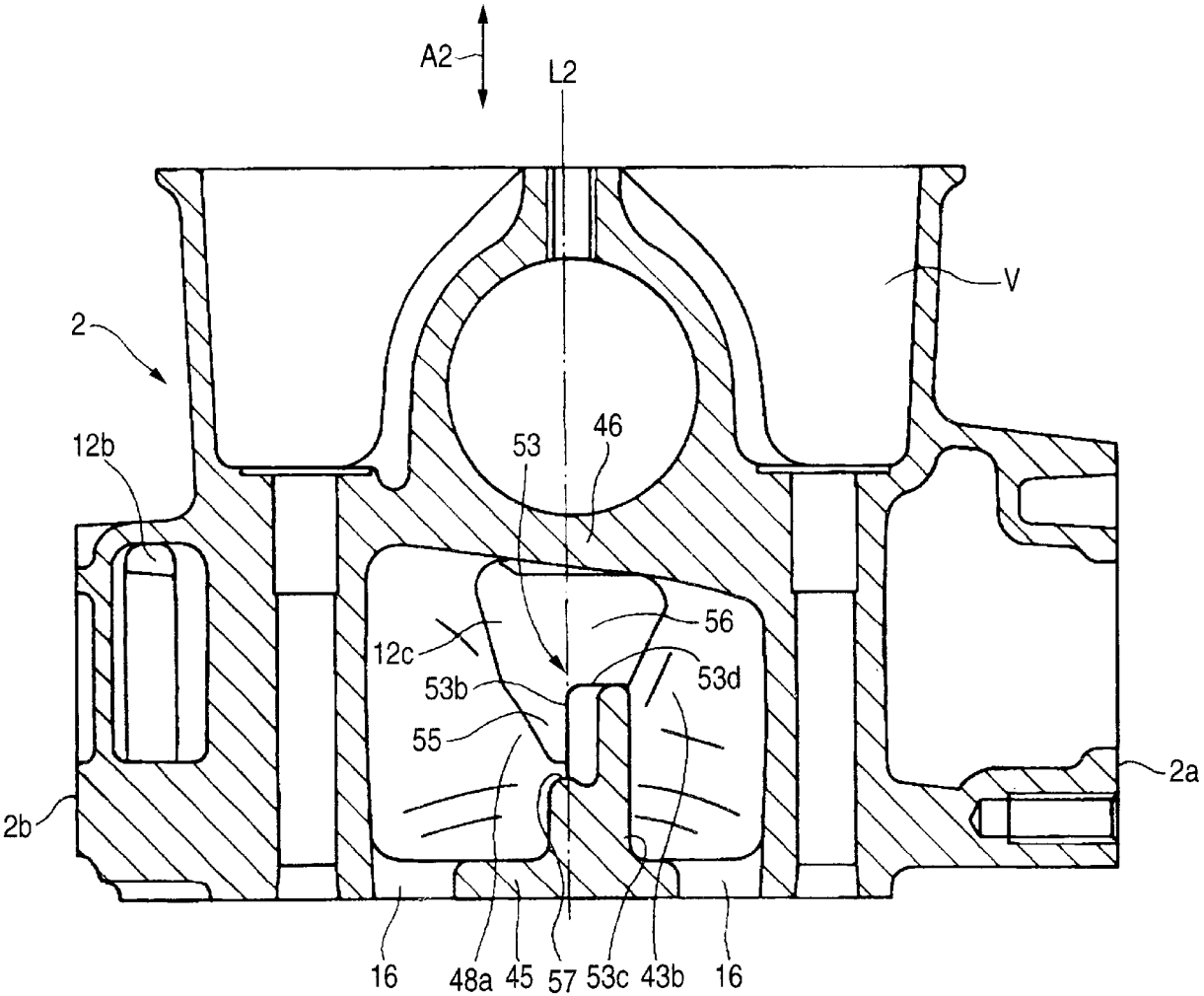
FIG. 5 is a sectional view taken along the line V—V in FIG. 3.

Referring to FIG. 3 mainly together with FIG. 5, of the combustion chambers $\mathbf{8}_1$ to $\mathbf{8}_4$, except for the combustion chamber $\mathbf{8}_4$ of the left end mostly distanced from the inlet port 35 in the cylinder head center line directional, in intake-valve-port side port wall portions 47*a* of the port walls 47 forming the intake ports 40 respectively communicating with the combustion chambers $\mathbf{8}_2$; $\mathbf{8}_3$; $\mathbf{8}_4$ positioned from the inlet port 35 toward the downstream of the coolant flow in that order, plate-like deflecting ribs 53, 54 are integrally formed with the cylinder head 2 at portions close to the adjacent combustion chambers $\mathbf{8}_2$; $\mathbf{8}_3$; $\mathbf{8}_4$ at the downstream side of the coolant.

In the combustion chambers $\mathbf{8}_1$, $\mathbf{8}_2$; $\mathbf{8}_2$, $\mathbf{8}_3$; $\mathbf{8}_3$, $\mathbf{8}_4$ which are contiguous with each other in the cylinder-head center line direction A1, of deflecting ribs 53, 54 provided between the intake-valve-port side port wall portion 47*a* of the combustion chambers $\mathbf{8}_1$; $\mathbf{8}_2$; $\mathbf{8}_3$ which are situated on an upstream side of the coolant flow and an exhaust-valve-port side port wall portion 48*a* of the combustion chambers $\mathbf{8}_2$; $\mathbf{8}_3$; $\mathbf{8}_4$ which are situated downstream of the combustion chambers $\mathbf{8}_1$; $\mathbf{8}_2$; $\mathbf{8}_3$, the deflecting rib 53 for the two chambers $\mathbf{8}_1$; $\mathbf{8}_2$ is provided in such a manner as to protrude upwardly from the bottom wall 45, extends in a curved fashion toward the exhaust-valve-port side port wall portion 48*a* of the port wall 48 which forms the exhaust port 41 of the combustion chambers $\mathbf{8}_2$; $\mathbf{8}_3$ which are contiguous therewith on the downstream side. The deflecting rib 53 has a proximal portion 53*a*, a distal portion 53*b* and a lower portion 53*c* and an upper end portion 53*d*. The proximal portion 53*a* is a portion connecting to the intake-valve-port side port wall portion 47. The distal portion 53*b* is an end portion facing the exhaust-valve-port side port wall portion 48*a*. The lower portion 53*c* is a portion connecting to the bottom wall 45, whereas the upper end portion 53*d* is an end portion facing the upper wall 46.

Then, the distal portion 53*b* substantially reaches the imaginary plane and has a predetermined height in a centrally axial direction A2 which is a direction of a central axis of the cylinder bore 5*a*, or, a height in this embodiment in which the upper end portion 53*d* is situated at a position which is slightly lower than a central position of the central jacket portion 12*c* in the centrally axial direction A2.

Each deflecting rib 53 is formed in such a manner as to leave a gap between the distal end portion 53*a* and the exhaust-valve-port side port wall portion 48*a* for allowing the coolant flowing through the central jacket portion 12*c* to flow along wall surfaces of the bottom wall 45 and the exhaust-valve-port side port wall portion 48*a*. Furthermore, a gap 56 is also formed between the upper end portion 53*d* and the upper wall 46.

The deflecting rib 54 extending from the intake-valve-port side port wall portion 47*a* for the combustion chamber $\mathbf{8}_3$ which corresponds to the third cylinder $\mathbf{5}_3$ differs from the deflecting rib 53 in that the rib is formed into a flat plate-like configuration and that it extends over a shorter distance toward the exhaust-valve-port side port wall portion 48*a*. These differences are caused by the fact that the deflecting rib 54 is provided on the intake-valve-port side port wall portion 47*a* which is situated at a position close to the downstream end portion of the coolant jacket 12 and the fact that the flow rate of the coolant flowing in the central jacket portion 12*c* in the cylinder-head center line direction A1 becomes smaller in the vicinity of the deflecting rib 54 compared with the flow rate in the vicinity of the deflecting rib 53 which is situated upstream of the deflecting rib 54. However, the cooling effect provided by the deflecting rib 54 on the exhaust-valve-port side port wall portion 48*a* is substantially equal to that provided by the deflecting rib 53.

Thus, the configuration and the location of the deflecting ribs 53, 54 are suitably set with a view to mainly attaining the improvement in cooling effect on the exhaust-valve-port side port wall portion 48*a* by deflecting the flow of coolant toward the exhaust-valve-port side port wall portion 48*a*.

Thus, the respective deflecting ribs 53, 54 allow of the coolant flowing in the central jacket portion 12*c* between the intake-valve-port side port wall portions 47*a* and the exhaust-valve-port side port wall portions 48*a* of the respective combustion chambers $\mathbf{8}_1$ to $\mathbf{8}_4$, the coolant which flows at positions closer to the bottom wall 45 and the intake-valve-port side port wall portions 47*a* to flow toward the exhaust-valve-port side port wall portions 48*a* of the combustion chambers $\mathbf{8}_2$; $\mathbf{8}_3$; $\mathbf{8}_4$ which contiguous with each other on the downstream side while allowing the coolant which flows at a position closer to the upper wall 46 of the central jacket portion 12*c* to flow in the cylinder-head central direction A1 through the gap 56.

In addition, a central rib 57 extending linearly continuously along the imaginary plane between the left-end and right-end portions of the cylinder head 12 is formed on the imaginary plane (on the cylinder head center line L1 as viewed from the top) in such a manner as to protrude from the bottom wall 45 to a height which is lower than the deflecting ribs 53, 54. Then, the distal portions 53*b*, 54*b* of the deflecting ribs 53, 54 are connected to the central rib 57.

Furthermore, a rib 58 is formed on the exhaust-valve-port side port wall portion 48*a* of the combustion chamber $\mathbf{8}_1$ which is closest to the inlet port 35 situated at the right-end portion of the cylinder head 2 at a position closer to a communicating portion 12*d*. The rib extends toward the mount portion 43 in the normal direction to reach the imaginary plane and has a height which is substantially equal to those of the deflecting ribs 53, 54. Then, part of the coolant which flows from the inlet port 35 toward the central jacket portion 12*c* is deflected by this rib 58 to be allowed to flow toward the exhaust jacket portion 12*b*.

In addition, an exhaust gas outtake passage 59 of an exhaust gas recirculating device for recirculating exhaust gases to the intake system of the internal combustion engine E is made to open to the exhaust port 41 of the combustion chamber $8_1$ which is closest to the right-end portion of the cylinder head 2. This exhaust gas outtake passage 59 extends along the communicating portion 12*d* of the coolant jacket 12 in a direction normal to the imaginary plane while passing over the inlet port 35 to thereby open in the front side 2*a* of the cylinder head 2. Furthermore, the passage 59 communicates with a recirculation control valve (not shown) for controlling the amount of coolant which is recirculated to the induction system.

Figure 6:
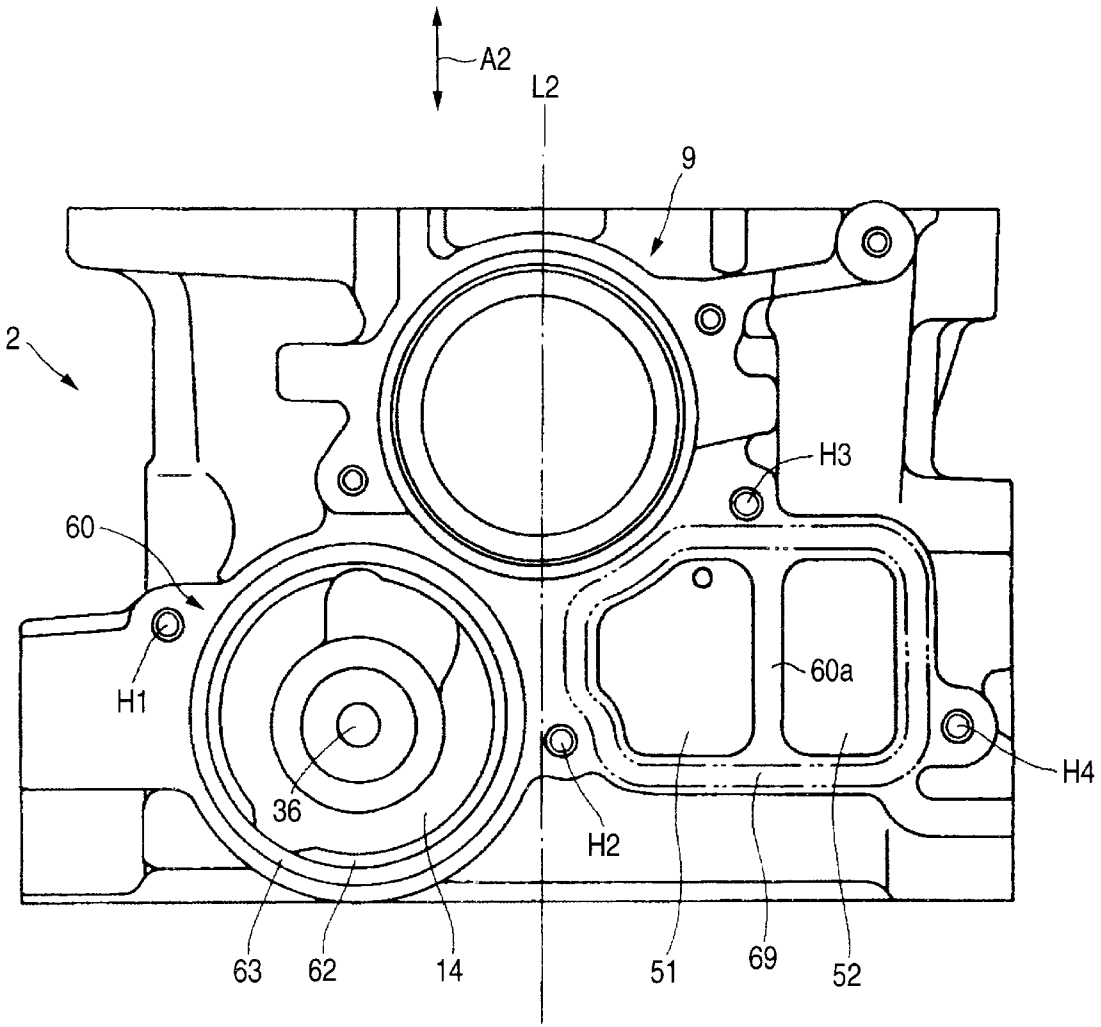
FIG. 6 is a left-hand side view of the cylinder head of the internal combustion engine shown in FIG. 1.
Figure 7:
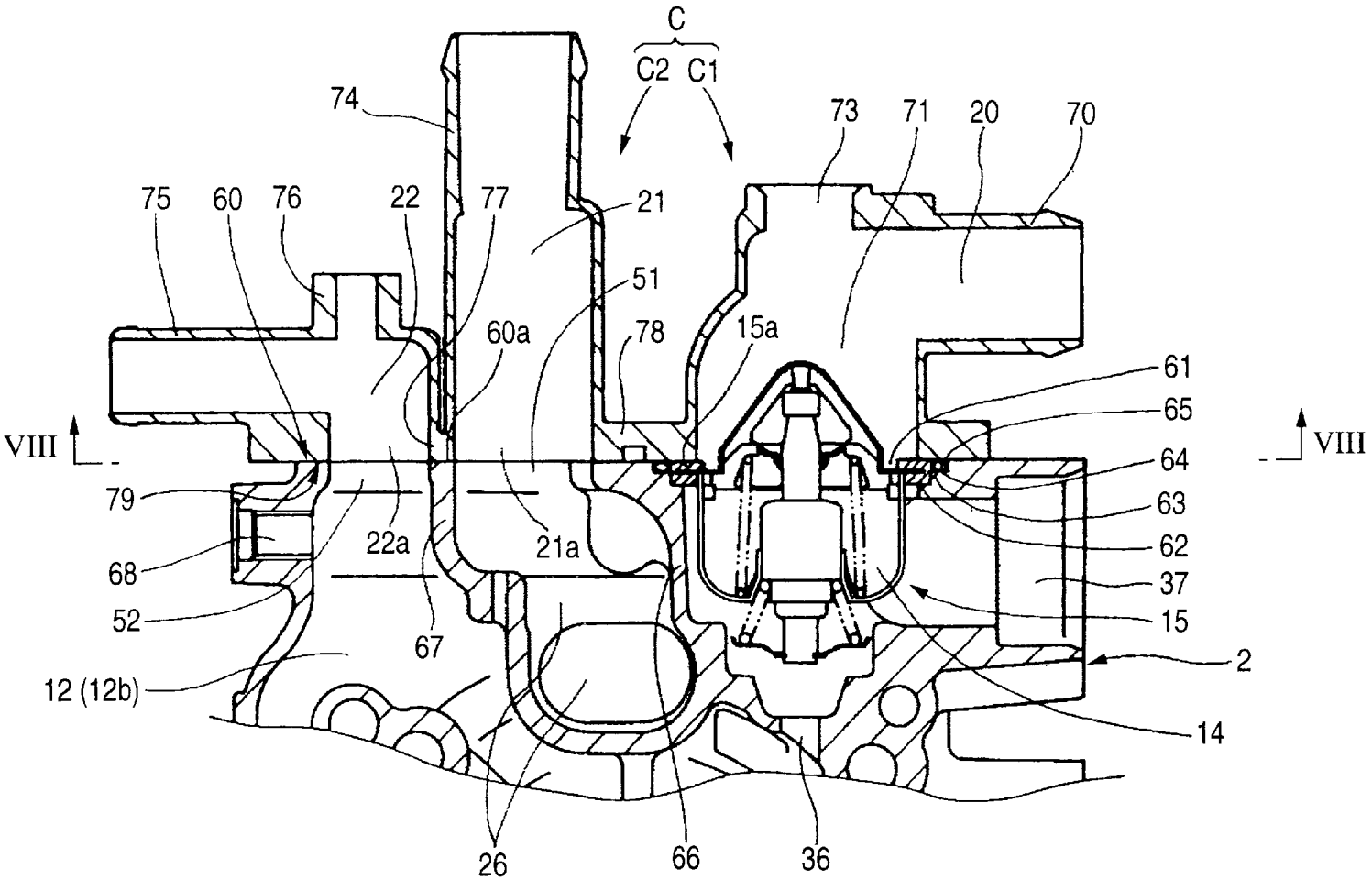
FIG. 7 is a plan sectional view showing a main portion at a left end portion of the cylinder head of the internal combustion engine shown in FIG. 1 in which a thermostat cover is mounted.
Figure 8:
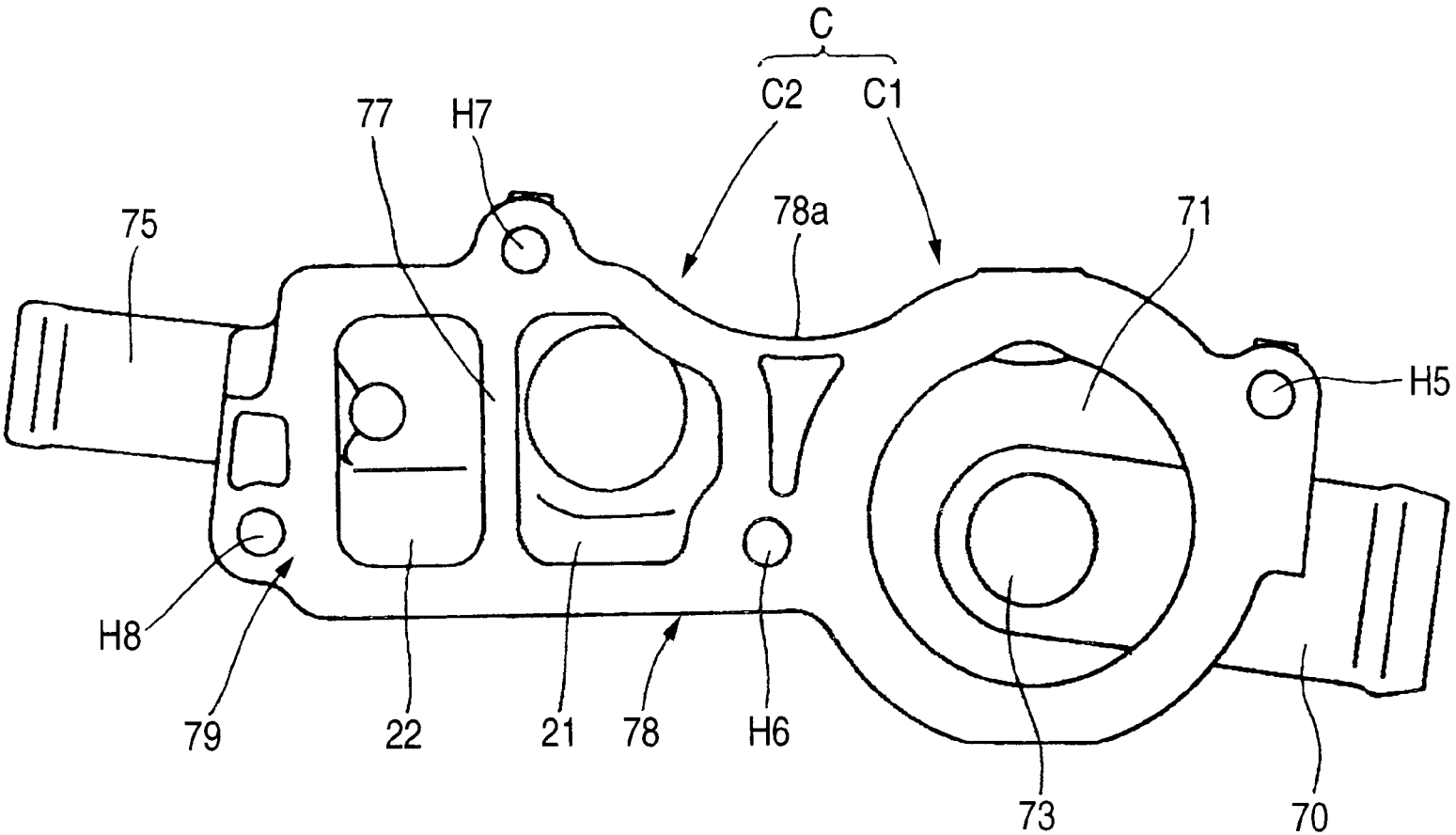
FIG. 8 is a view as seen in a direction indicated by arrows VIII—VIII in FIG. 7.

Next, referring to FIGS. 6 to 8, described will the thermostat cover C which is mounted at the left-end portion of the cylinder head 2.

Referring to FIGS. 6, 7, a mount surface 60 is formed on a left-end face of the cylinder head 2 where the thermostat cover C is mounted. The accommodating chamber 14 formed at the left-end portion of the cylinder head 2 and comprising a recessed portion is situated on the intake-side of the cylinder head 2 and downward and ahead of the protruding portion 9 which is situated on the axial extension from the camshaft and has an inlet port 61 which is made to open in the mount surface 60. A stepped portion 62 is formed on a circumferential edge portion of the inlet port 61 on which an annular holding portion 15*a* of the thermostat 15 is placed, whereby the thermostat 15 is fixed to the cylinder head 2 when the holding portion 15*a* is held between the stepped portion 62 and the thermostat cover C. Thus, the thermostat 15 and the accommodating chamber 14 are provided on the intake side of the cylinder head 2 so that they are situated on the same side of the coolant circulating pump 13 which is provided on the intake side of the cylinder block 1.

Then, a stepped portion 63 which is shallower than the stepped portion 62 is formed on the outer circumferential side of the stepped portion 62, and an annular resilient packing 65 of a synthetic rubber or synthetic resin such as an O ring is fitted in an annular groove 64 formed by the stepped portion 63 and the holding portion 15*a*.

The communicating passage 26, which is situated rearward of the accommodating chamber 14 via a partition wall 66 has the outlet port 51 which is made to open in the mount surface 60. The outlet port 52 of the coolant jacket 12 is made to open rearward of the outlet port 51 with a partition surface 60*a*, which constitutes part of the mount surface 60, of a partition wall 67 extending in the centrally axial direction A2 being held between the coolant jacket 12 and the passage 26. In addition, a mount hole 68 is formed in such a manner as to open from the rear side 2*b* of the cylinder head 2 to the outlet port 52 for receiving therein a coolant temperature sensor for detecting the temperature of coolant at the outlet port 52.

Furthermore, a liquid packing 69 comprising a silicon material which is a sealing material for, for example, FIPG is applied to a non-circular annular application area on circumferential edge portions of the two outlet ports 51, 52 on the mount surface 60 except for the partition surface 60*a*.

On the other hand, referring to FIGS. 1, 7 and 8, the thermostat cover C attached to the mount surface 60 has a first cover portion C1 forming an accommodating chamber 71 for accommodating part of the thermostat 15 so that the thermostat 15 and the inlet port are covered and a second cover portion C2 for covering the two outlet ports 51, 52. The thermostat cover C is integrally cast of an aluminum alloy. Furthermore, four through holes H5 to H8 are formed at positions corresponding to threaded holes H1 to H4 (refer to FIG. 6) formed in the mount surface 60 so that four bolts B (refer to FIG. 1) are put therethrough in order to fasten the thermostat cover C to the cylinder head 2 therewith.

Then, formed in the first cover portion C1 are a connecting portion 70, the inlet passage 20 and a mount hole 73. The connecting portion 70 is connected to the radiator hose 23 (refer to FIG. 2). The inlet passage 20 is adapted to communicate with the radiator hose 23 for allowing the coolant cooled in the radiator 25 to flow into the accommodating chamber 71 accommodating part of the thermostat 15 and further to the inlet port 61. A temperature switch 72 (refer to FIG. 1) for detecting the temperature of the coolant from the radiator 25 is attached to the mount hole 73.

On the other hand, formed on the second cover portion C2 are a connecting portion 74 to which the radiator hose 24 is connected and which is situated at a position closer to the first cover portion C1 and a connecting portion 75 to which the hose 27 (refer to FIG. 2) is connected to and which is situated rearward of the connecting portion 74. Further, in the second cover portion C2, the outlet passage 21 and the outlet passage 22 are formed in such a manner as to be partitioned by a partition wall 77. The outlet passage 21 has an inlet port 21*a* which substantially aligns with the outlet port 51 and is adapted to communicate with the radiator hose 24 (refer to FIG. 2) so that coolant from the outlet port 51 is allowed to flow into the radiator 25. The outlet passage 22 has an inlet port 22*a* which substantially aligns with the outlet port 52 and is adapted to communicate with the both hoses 27, 30 so that coolant from the outlet port 52 is allowed to flow into the heater core 29 and the throttle body 7, respectively.

Furthermore, a flange 78 of the thermostat cover C has a mount surface 79 which is adapted to be brought into abutment with the mount surface 60 of the cylinder head 2 to mate therewith, and constitutes part of the first and second cover portions C1, C2. The flange 78 has a curved recessed portion 78*a* that corresponds to the configuration of an outer circumferential surface of a lower portion of the protruding portion 9, whereby the camshaft and the thermostat 15 and both outlets 51, 52 can be disposed as close to each other as possible in the centrally axial direction A2 by allowing the lower portion of the protruding portion 9 to be fitted in the recessed portion 78.

Next, described below will be the function and effectiveness of the first embodiment which is constructed as has been described heretofore.

As shown in FIG. 3, coolant flowing into the coolant jacket 12 from the inlet port 35 situated at the front-end portion and the right-end portion and in the vicinity thereof of the coolant jacket 12 is directed to the central jacket portion 12*c* and the exhaust-side jacket portion 12*b* after flowing through the communicating portion 12*d* while flowing through the intake-side jacket portion 12*a*. Of these flows of coolant, since part of the coolant directed to the central jacket portion 12*c* is deflected by the rib 58 so as to be directed to the exhaust-side jacket portion 12*b*, more coolant is allowed to flow through the exhaust-side jacket portion 12*b*. Thus, the coolant is allowed to flow in the respective jacket portions 12*a*, 12*b*, 12*c* toward the left-end portion of the cylinder head 12 and when the engine is in hot operating conditions, part of the coolant flows into the coolant jacket 12 in the cylinder block from the communicating passage 16.

Then, the flows of coolant flowing in the central jacket portion 12*c* at the positions closer to the bottom wall 45 and the intake-valve-port side port wall portion 47*a* are deflected by the deflecting ribs 53, 54 toward the exhaust-valve-port side port wall portions 48*a* of the combustion chambers $\mathbf{8}_2$; $\mathbf{8}_3$; $\mathbf{8}_4$ which are contiguous with the combustion chambers $\mathbf{8}_1$; $\mathbf{8}_2$; $\mathbf{8}_3$ situated on the downstream side thereof, respectively. Then, the coolant so deflected flows against the exhaust-valve-port side port wall portions 48*a*, and thereafter the coolant that has so flowed joins the coolant in the exhaust-side jacket portion 12*b*.

In the exhaust-side jacket portion 12*b*, the coolant flows on the bottom wall 45 side and the upper wall 46 side relative to each exhaust port 41 and between the adjacent walls of the exhaust ports 41 toward the left-end portion of the cylinder head 2. Then, the coolant flows out from the outlet port 52 situated on the rear-end portion and the left-end portion of the cylinder head 2 toward the heater core 29 and the throttle body 7.

As this occurs, as shown in FIGS. 4, 5, the deflecting ribs 53, 54 are provided between the intake-valve-port side port wall portions 47*a* of the combustion chambers $\mathbf{8}_1$; $\mathbf{8}_2$; $\mathbf{8}_3$ which are situated on the upstream side of the flow of coolant and the exhaust-valve-port side port wall portions 48*a* of the combustion chambers $\mathbf{8}_2$; $\mathbf{8}_3$; $\mathbf{8}_4$ which are situated downstream of the combustion chambers $\mathbf{8}_1$; $\mathbf{8}_2$; $\mathbf{8}_3$ in such a manner as to protrude upwardly from the bottom wall 45. Further, the deflecting ribs 53, 54 are formed in such a manner as to leave the gaps 55 between the exhaust-valve-port side port wall portions 48 and themselves, respectively, so that the coolant flows on the respective walls of the bottom wall 45 including the central rib 57 and the exhaust-valve-port side port wall portion 48*a*, whereby there is no risk that the coolant stagnates on the respective wall surfaces of the bottom wall 45 and the exhaust-valve-port side port wall portion 48*a* at the portion where the gap 55 is formed.

As a result, since part of the coolant is deflected to flow toward the exhaust-valve-port side port wall portion 48*a* which has the highest heat load among the walls of the cylinder head 2 forming the coolant jacket 12, the cooling effect on the exhaust-valve-port side port wall portion 48*a* is improved, and being different from the case where the conventional continuous rib is used, there is caused no stagnation of coolant on the respective walls of the bottom wall 45 and the exhaust-valve-port side port wall portion 48*a* at the position where the gap 55 is formed. Furthermore, part of the coolant flows around the back of the deflecting ribs 53, 54 from the gap 55, whereby since an area on the wall of the bottom wall 45 where the stagnation of coolant is generated is reduced, the area where the stagnation of coolant is generated by the deflecting ribs 53, 54 is in turn reduced, the cooling effect on the bottom wall 45 and the exhaust-valve-port side port wall portion 48*a* being thereby improved, this allowing the portion having the highest heat load to be cooled effectively. The amount of heat received by the coolant is increased by the effective cooling of the wall 45 and the exhaust-valve-port side port wall portion 48*a*. Thus, the heater performance is improved when the coolant whose temperature is so increased is supplied to the heater core 29.

Since the central rib 57 is provided on the bottom wall 45 of the cylinder head 2 which protrudes upwardly from the bottom wall 45 and extends in the cylinder-head center line direction A1 between the left- and right-end portions of the cylinder head 2, the coolant flowing between the intake-valve-port side port wall portion 47*a* and the exhaust-valve-port side port wall portion 48*a* of the cylinder head 2 is allowed to flow downstream while being straightened along the cylinder-head center line L1, whereby the chamber wall of the combustion chamber $\mathbf{8}_1$ to $\mathbf{8}_4$ constituted by the bottom wall 45, the intake-valve-port side port wall portion 47*a* and the exhaust-valve-port side port wall portion 48*a* can be cooled substantially equally. In addition, the central rib 57 and the deflecting ribs 53, 54 connecting to the central rib 57 contribute to the improvement in rigidity of the entirety of the cylinder head 2. Furthermore, since the central rib 57 and the deflecting rib 53 are provided to extend over the contiguous combustion chambers $\mathbf{8}_1$, $\mathbf{8}_2$; $\mathbf{8}_2$, $\mathbf{8}_3$, they contribute to the improvement in rigidity of the cylinder head 2 at portions between the combustion chambers $\mathbf{8}_1$, $\mathbf{8}_2$; $\mathbf{8}_2$, $\mathbf{8}_3$.

The respective jacket portions 12*a*, 12*b*, 12*c* are formed in such a manner as to extend substantially along the cylinder head center line direction A1 between the left and right end portions of the cylinder head 2. Moreover, an inlet port 35 is situated in the vicinity of the right front end portion of the coolant jacket 12 whereas an outlet port 52 is situated in the vicinity of the left rear end portion of the coolant jacket 12, whereby a distance between the inlet port 35 and the outlet port 52 can be extended within a coolant jacket 12 formation range. This increases the amount of heat that the coolant receives to thereby improve the heater performance. Furthermore, the outlet port 52 opens into the exhaust side jacket portions 12*b* where the coolant flows around the exhaust ports 41 whose heat load is high, and moreover, a by-pass passage 36 opens into the intake side jacket portion 12*a*. Thus, the temperature of the coolant in the exhaust side jacket portions 12*b* can be prevented from being reduced by the coolant in the intake side jacket portion 12*a*, whereby the temperature of the coolant flowing out of the outlet port 52 can be maintained high. The heater performance can also be improved in this respect.

Furthermore, since the outlet port 52 is formed in such a manner as to open in the exhaust-side jacket portion 12*b* in the cylinder-head center line direction A1, the stagnation of the coolant flowing in the exhaust-side jacket portion 12*b* formed along substantially the cylinder-head direction A1 is suppressed, whereby the coolant is allowed to flow toward the outlet port 52 smoothly, whereby the cooling effect is improved on the cylinder head 2 and, in particular, on the exhaust side thereof having the higher heat load.

Since the rib 49 connecting the port wall 48 and the upper wall 46 is provided on the extension in the centrally axial direction A2 of the side wall 2*c* of the valve train chamber V in the exhaust side jacket portion 12*b*, it is advantageous in improving the rigidity of the port wall 48 and the upper wall 46 which form the exhaust side jacket portion 12*b*. In addition, the heat transmission area is increased by the rib 49, which increases in turn the amount of heat that is transferred from the port wall 48 to the coolant. As a result, the cooling effect on the port wall 48 can be increased, and the increase in temperature of the coolant and heating performance can be promoted. Furthermore, since the rib 49 has the flat oval horizontal cross section along the cylinder center line direction A1 and is disposed on the straight line which is parallel to the cylinder head center line L1, the flow of the coolant in the exhaust side jacket portions 12*b* is straightened, allowing the coolant to flow smoothly. In this respect, too, the cooling effect on the exhaust side of the cylinder head 2 can be improved.

In addition, at the left end portion of the cylinder head 2, an accommodating chamber 14 for accommodating a thermostat 15 is provided on the intake side where a space is formed, not the exhaust side where hoses 24, 27 are disposed which are connected to the outlet ports 51, 52 through which the coolant flows to a radiator 25 and a heater core 29. Thus, the hoses including a radiator hose 23 communicating with the thermostat 15 can be disposed compact in the cylinder head center line direction A1, this helping make the internal combustion engine E compact.

Since the thermostat 15 is provided at the left-end portion of the cylinder head 2 rather than at the right-end portion thereof where the valve train mechanism is provided for rotationally driving the camshaft, there is no limitation imposed by the members disposed around the routing of the radiator hose 23 for allowing the coolant to flow into the thermostat 15, whereby the internal combustion engine can be made compact. Moreover, since the thermostat 15 and the accommodating chamber 14 are provided on the intake side of the cylinder block 1 whereas the coolant circulating pump 13 is provided on the intake side of the cylinder head 2, the thermostat 15 and the coolant circulating pump 13 can be situated on the same side relative to the main body of the internal combustion engine E, whereby the distance from the thermostat 15 to the coolant circulating pump 13 can be shortened, thereby making it possible to make the internal combustion engine E compact.

Formed on the first cover portion C1 of the thermostat cover C on which the first and second cover portions C1, C2 is formed integrally the inlet passage 20 for allowing the coolant from the radiator 25 to flow into the inlet port 61 accommodating the thermostat 15 with the radiator hose 23 being connected to the connecting portion 70, whereas formed on the second cover portion C2 are the outlet passage 21 for allowing the coolant from the outlet port 51 to flow out into the radiator 25 with the radiator hose 24 being connected to the connecting portion 74 and the outlet passage 22 for allowing the coolant from the outlet port 52 to flow out into the core heater 29 and the throttle body 7 with the hoses 27, 30 being connected to the connecting portions 75, 76, respectively. Thus, on the mount surface 60 the connecting portions 70, 74, 75, 76 to which the hoses 23, 24, 27, 30 for establishing communications between the inlet port 61 and the two outlet ports 51, 52 which are formed in the mount surface 60 and the radiator 25, the heater core 29 and the throttle body 7 are formed on the thermostat cover C which is the single member, and moreover, they are collectively disposed at the left-end portion of the cylinder head 2, whereby the connection of the respective hoses 23, 24, 27, 30 is facilitated through which the coolant is allowed to flow, the working efficiency being thereby improved. This helps improve the assembling performance of the internal combustion engine E and obviates the necessity of preparation of members required for the supply of the coolant to the heater core 29 and the throttle body 7 such as joints, whereby the number of components involved can be reduced. As a result, the man hours associated with the assembly of the joints can be reduced, and in this respect the assembling performance of the internal combustion engine can be improved.

Furthermore, since the recessed portion 78*a* is formed in the flange portion 78 of the thermostat cover C for receiving therein the lower portion of the protruding portion 9 which protrudes from the left-end portion of the cylinder head 2, the camshaft and the thermostat 15 and the outlet ports 51, 52 can be disposed as close to each other as possible in the centrally axial direction A2, whereby the dimensions of the internal combustion engine E can be reduced in the cylinder-head center line direction A1, as well as in the centrally axial one A2. As a result, the overall height of the internal combustion engine E can be reduced.

Figure 9:
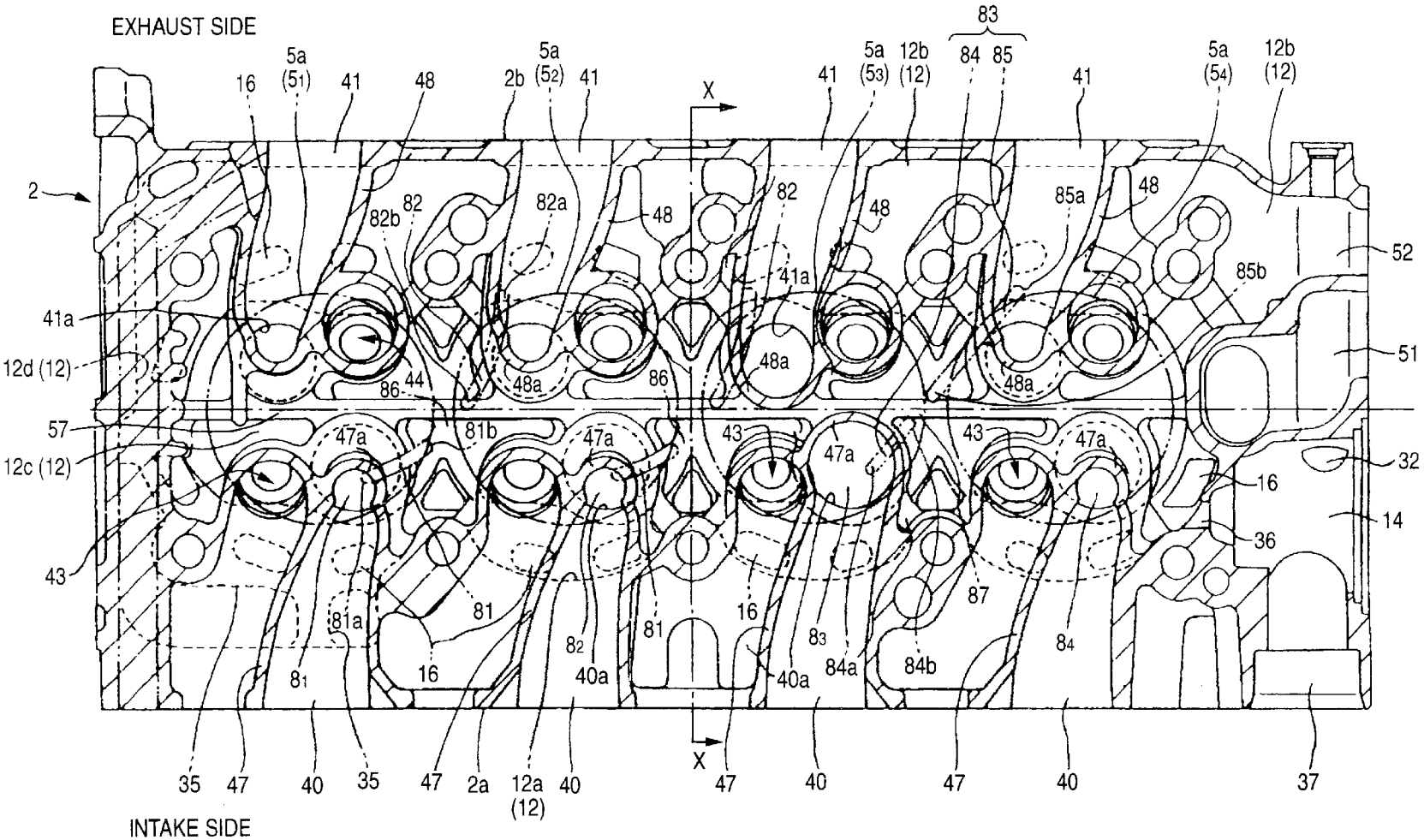
FIG. 9 is a plan sectional view showing a second embodiment of the invention which corresponds to FIG. 3 showing the first embodiment.
Figure 10:
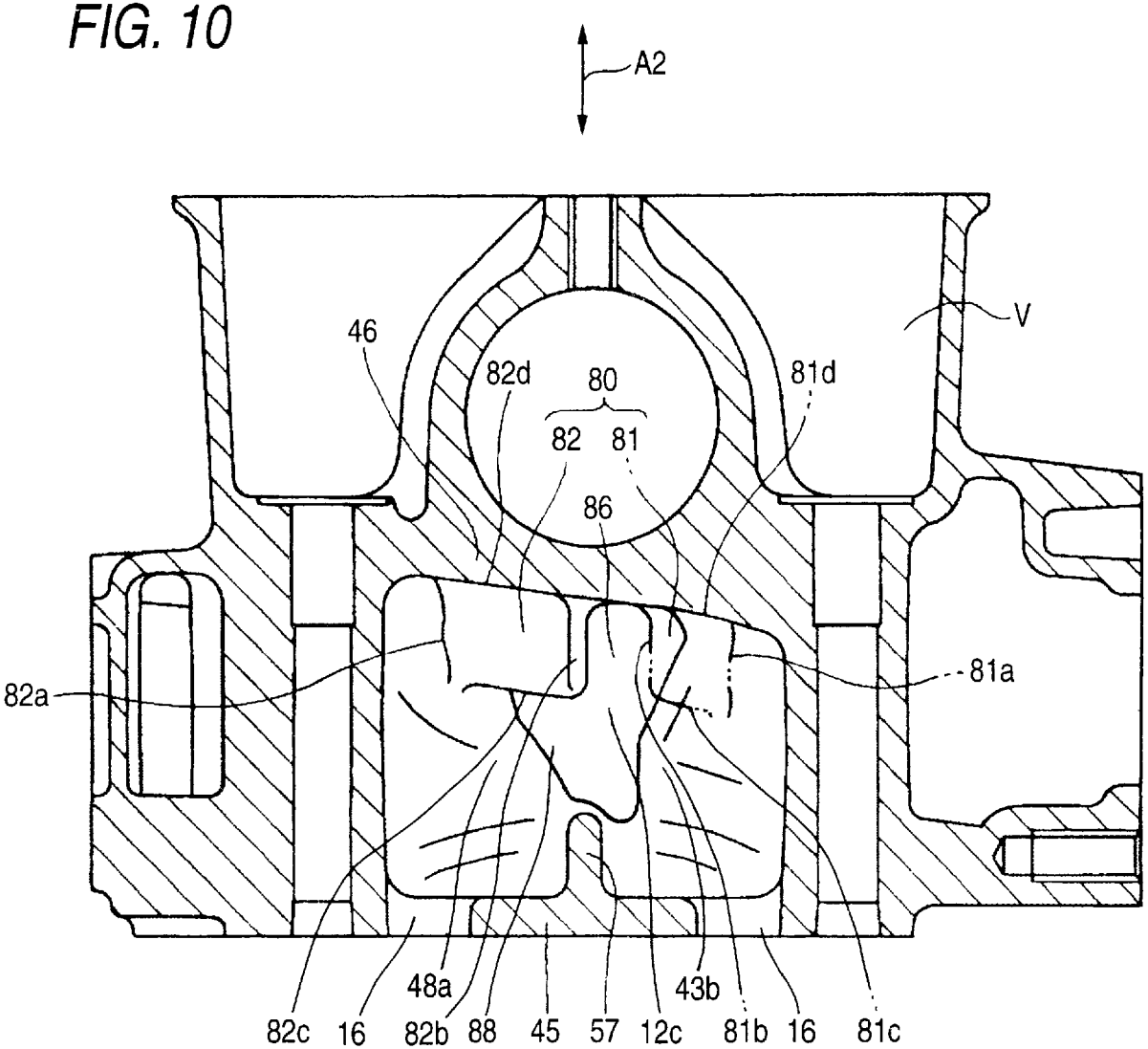
FIG. 10 is a sectional view taken along the line X—X in FIG. 9.

Next, referring to FIGS. 9 and 10, a second embodiment of the invention will be described. This second embodiment is different from the first embodiment in that the former has deflecting ribs which are formed at different positions and which have different configurations. Note that in describing the second embodiment like portions to those described with reference to the first embodiment being omitted or described briefly, only features of the second embodiment which are different from those of the first embodiment will be described mainly. In addition, like reference numerals will be imparted to like or corresponding members to those of the first embodiment.

Deflecting ribs 80 are each constituted by an intake side deflecting rib 81 and an exhaust side deflecting rib 82. The intake side deflecting ribs 81 having a curved plate shape are formed integrally with portions of the cylinder head 2 which are closer to combustion chambers $\mathbf{8}_2$; $\mathbf{8}_3$ which are contiguous with combustion chambers $\mathbf{8}_1$; $\mathbf{8}_2$ on a downstream side of the flow direction of coolant at intake-valve-port side port wall portions 47*a* of a port walls 47 which form intake ports 40 of combustion chambers $\mathbf{8}_1$; $\mathbf{8}_2$.

Then, the intake side deflecting ribs 81 are provided in such a manner as to protrude downwardly from upper walls 46 and extend toward exhaust valve port side port wall portions 48*a* of a port wall 48 which forms exhaust ports 41 of the combustion chambers $\mathbf{8}_2$; $\mathbf{8}_3$ which are contiguous with combustion chambers $\mathbf{8}_1$; $\mathbf{8}_2$ on the downstream side of the flow direction of the coolant. Each intake side deflecting rib 81 has a proximal portion 81*a* which is a portion connecting to the intake-valve-port side port wall portion 47*a*, a distal portion 81*b* which faces the exhaust side deflecting rib 82, a lower end portion 81*c* which is an end portion facing a bottom wall 45 and an upper portion 81*d* which is a portion connecting to the upper wall 46. The distal portion 81*b* does not reach an imaginary plane, and the lower end portion 81*c* has a height which is slightly higher than the central position of the central jacket portion 12*c* in the centrally axial direction A2.

In addition, the exhaust side deflecting ribs 82 are provided in such a manner as to protrude downwardly from the upper walls 46 and extend toward the intake-valve-port side port wall portions 47*a* of the combustion chambers $\mathbf{8}_1$; $\mathbf{8}_2$ which are contiguous with each other on an upstream side of the flow direction of the coolant. Each intake side deflecting rib 82 has a proximal portion 82*a* which is a portion connecting to the exhaust valve port side port wall portion 48*a*, a distal portion 82*b* which is an end portion facing the intake side deflecting rib 81, a lower end portion 82*c* which is an end portion facing the bottom wall 45 and an upper portion 82*d* which is a portion connecting to the upper wall 46. The distal portion 82*b* substantially reaches the imaginary plane, and the lower end portion 82*c* has a height which is slightly higher than the central position of the central jacket portion 12*c* in the centrally axial direction A2.

Additionally, intake side and exhaust side deflecting ribs 84, 85 which are deflecting ribs constituting a deflecting rib 83 and extend, respectively, from the intake-valve-port side port wall portion 47*a* of the combustion chamber $\mathbf{8}_3$ and the exhaust valve port side port wall portion 48*a* of the combustion chamber $\mathbf{8}_4$ are different from the intake side and exhaust side deflecting ribs 81, 82 in that the former are each formed into a flat plate-like configuration. However, the difference is based on the same reason as that of the first embodiment, and the basic construction and cooling effect on the exhaust valve port side port wall portion 48*a* of the deflecting rib 83 are substantially identical to those of the deflecting rib 80.

Gaps 86, 87 reaching the upper walls 46 are formed at intermediate positions of the deflecting ribs 80, 83 between the distal portions 81*b*, 84*b* of the intake side deflecting ribs 81, 84 and the distal portions 82*b*, 85*b* of the exhaust side deflecting ribs 82, 85, respectively. Furthermore, gaps 88 are formed among the respective lower ends 81*c*, 82*c* of the intake side deflecting ribs 81 and the exhaust side deflecting ribs 82, the bottom walls 45, the intake-valve-port side port wall portions 47*a* and the exhaust valve port side port wall portions 48*a* so as to allow the coolant to flow along the respective wall surfaces of the bottom walls 45, the intake-valve-port side port wall portions 47*a* and the exhaust valve port side port wall portions 48*a*. In addition, a gap 88 is formed among the respective lower end portions of the intake side deflecting rib 84 and the exhaust side deflecting rib 85 and the exhaust valve port side port wall portion 48*a*, the bottom wall 45 and the intake-valve-port side port wall portion 47*a* so as to allow the coolant to flow along the wall surfaces of the exhaust valve port side port wall portion 48*a*, the bottom wall 45 and the intake-valve-port side port wall portion 47*a*. In addition, the gaps 86, 87 are intended to expel air that may remain between the deflecting ribs 80, 83 and the upper walls 46 therefrom when coolant is poured into the coolant jacket 12, and furthermore, the gaps function to facilitate the loading of sand for sand inserts for forming the coolant jacket 12 at the time of casting the cylinder head 2, whereby the shape forming characteristics of the sand inserts can be improved.

According to the second embodiment, the following advantage is provided. Namely, the flow of coolant flowing near the upper wall 46 of the central jacket portion 12*c* is deflected toward the exhaust valve port side port wall portions 48*a* of the combustion chambers $8_2$; $8_3$; $8_4$ which are contiguous, respectively, with the combustion chambers $8_1$; $8_2$; $8_3$ on the downstream side of the coolant flow by the intake side and exhaust side deflecting ribs 81, 82; 84, 85. Further, the flow of coolant so deflected is then directed against the exhaust valve port side port wall portions 48*a*. Thereafter, the coolant flows into the coolant in the exhaust side jacket portions 12*b*.

As this occurs, the lower end portions 81*c*, 82*c* of the intake side and exhaust side deflecting ribs 81, 82 which are provided between the intake-valve-port side port wall portions 47*a* of the combustion chambers $8_1$; $8_2$ on the upstream side of the coolant flow and the exhaust valve port side port wall portions 48*a* of the combustion chambers $8_2$; $8_3$ which are situated downstream of the combustion chambers $8_1$; $8_2$, respectively, and protrude downwardly from the upper walls 46 form the gaps 88 between the bottom walls 45, the intake-valve-port side port wall portions 47*a* and the exhaust valve port side port wall portions 48*a* and themselves so as to allow the coolant to flow along the respective wall surfaces of the bottom walls 45, the intake-valve-port side port wall portions 47*a* and the exhaust valve port side port wall portions 48*a*. Further, the lower end portions of the intake side and exhaust side deflecting ribs 84, 85 which are provided between the intake-valve-port side port wall portion 47*a* of the combustion chamber $8_3$ on the upstream side of the coolant flow and the exhaust-valve-port side port wall portion 48*a* of the combustion chamber $8_4$ which is situated downstream of the combustion chamber $8_3$ and protrude downwardly from the upper wall 46 form the gap 88 between the bottom wall 45, the intake-valve-port side port wall portion 47*a* and the exhaust-valve-port side port wall portion 48*a* so as to allow the coolant to flow along the respective wall surfaces of the bottom wall 45, the intake-valve-port side port wall portion 47*a* and the exhaust-valve-port side port wall portion 48*a*. Thus, there is no risk that the coolant stagnates on the respective wall surfaces of the bottom walls 45, the intake-valve-port side port wall portions 47*a* and the exhaust-valve-port side port wall portions 48*a*.

As a result, since part of the coolant is deflected to flow toward the exhaust-valve-port side port wall portions 48*a* which have the highest heat load among the walls of the cylinder head 2 which constitute the coolant jacket 12, the cooling effect on the exhaust-valve-port side port wall portions 48*a* is improved. Moreover, the coolant flowing through the gaps 88 and the gap formed by the deflecting rib 83 eliminates the occurrence of stagnation of coolant on the respective wall surfaces of the bottom walls 45, the intake-valve-port side port wall portions 47*a* and the exhaust-valve-port side port wall portions 48*a* at the portions where the gaps are formed, whereby the bottom walls 45 and the exhaust-valve-port side port wall portions 48 whose heat loads are high are cooled effectively, and moreover, the intake-valve-port side port wall portions 47*a* are also cooled.

Furthermore, even in this second embodiment, advantages similar to those provided by the first embodiment can be provided except for the function and effects which are inherent in the deflecting ribs 53, 54 of the first embodiment.

The constructions of embodiments will be described below in which the constructions of the embodiments that have been described heretofore are partly modified.

While in the first embodiment, the deflecting ribs 53, 54 extend from the intake-valve-port side port wall portions 47*a*, and the gaps 55 are formed between the exhaust-valve-port side port wall portions 48*a* and the ribs, the deflecting ribs may be formed in such a manner as to extend from the exhaust-valve-port side port wall portions 48*a* to leave gaps between the intake-valve-port side port wall portions 47*a* and themselves. In addition, the deflecting rib may be formed such that deflecting rib pieces extend from the intake-valve-port side port wall portion 47*a* and the exhaust-valve-port side port wall portion 48*a* to leave a gap at an intermediate position of a deflecting rib constituted by the both deflecting rib pieces or between distal portions of the deflecting rib pieces which face each other. Furthermore, the deflecting rib may be formed such that the rib extends upwardly from the bottom wall 45, as well as toward the exhaust-valve-port side port wall portion 48*a* and the intake-valve-port side port wall portion 47*a* to leave gaps between the two wall portions and the rib so extending.

While in the second embodiment, the deflecting ribs 80, 83 are such that the ribs extend from the intake-valve-port side wall portions 47*a* and the exhaust-valve-port side port wall portions 48*a* and that the gaps 86, 87 are formed, the gaps 86, 87 may not be formed. In addition, the deflecting rib may be formed such that the rib extends downwardly from the upper wall 46, as well as from one of the intake-valve-port side port wall portion 47*a* and the exhaust-valve-port side port wall portion 48*a* to leave a gap between the other port wall portion and the rib. Furthermore, the deflecting rib may be formed such that the rib extends downwardly from the upper wall 46, as well as toward the exhaust-valve-port side port wall portion 48*a* and the intake-valve-port side port wall portion 47*a* to leave gaps between the both port wall portions and the rib so extending.

While in the first and second embodiments, the configuration of the deflecting ribs which correspond to part of the cylinders is different from the deflecting rib which corresponds to the remaining cylinder, all the deflecting ribs may be formed into the same configuration. In addition, while in the internal combustion engines E according to the respective embodiments, one intake valve and one exhaust valve are provided for the respective cylinders $8_1$ to $8_4$, there may be provided an internal combustion engine in which a pair of intake valves and a pair of exhaust valves are provided for each cylinder. While the internal combustion engine is the four-cylinder internal combustion engine in the respective embodiments, there may be used any other type of internal combustion engine such as a multi-cylinder internal combustion engine or a single-cylinder internal combustion engine.

What is claimed is:

1. A cylinder head cooling construction for an internal combustion engine with cylinders and a crankshaft, wherein a coolant jacket through which coolant is allowed to flow is formed by a wall of a cylinder head including bottom walls forming chamber walls of combustion chambers, intake port walls forming intake ports having intake valve ports which are opened and closed by intake valves and exhaust port walls forming exhaust ports having exhaust valve ports which are opened and closed by exhaust valves, wherein deflecting ribs are formed in said coolant jacket between intake-valve-port side port wall portions and exhaust-valve-port side port wall portions which are situated downstream of said intake-valve-port side port wall portions in a flow direction of said coolant in such a manner as to protrude upwardly from said bottom walls for directing said flow of coolant toward said exhaust-valve-port side port wall portions, and wherein said deflecting ribs for deflecting part of said flow of coolant which flows in a cylinder head center line direction toward said exhaust-valve-port side port wall portions between said intake-valve-port-side port wall portions and said exhaust-valve-port side port wall portions are formed such that said deflecting ribs leave gaps at one of first positions between at least one of said intake-valve-port side port wall portions and said exhaust-valve-port side port wall portions and said deflecting ribs, and second positions being an intermediate positions of said deflecting ribs extend from said intake-valve-port side port wall portions and said exhaust-valve-port side port wall portions, for allowing said coolant to flow wall surfaces of said bottom walls, wall surfaces of said intake-valve-port side port wall portions, or wall surfaces of said exhaust-valve-port side port wall portions.

2. The cylinder head cooling construction for an internal combustion engine as set forth in claim 1, wherein said deflecting ribs are formed to extend from said intake-valve-port side port wall portions, and wherein said gaps are formed between said exhaust-valve-port side port wall portions and said deflecting ribs for allowing said coolant to flow on the wall surfaces of said exhaust-valve-port side port wall portions.

3. The cylinder head cooling construction for an internal combustion engine as set forth in claim 1, wherein said internal combustion engine is a multi-cylinder internal combustion engine, wherein said deflecting rib is formed between said intake-valve-port side port wall portion of one of two cylinders which are contiguous with each other in said cylinder head center line direction and said exhaust-valve-port side port wall portion of the other cylinder, and wherein said deflecting rib is connected to a central rib which protrudes upwardly from said bottom wall and extends in said cylinder head center line direction between both end portions of said cylinder head.

4. The cylinder head cooling construction for an internal combustion engine as set forth in claim 2, wherein said internal combustion engine is a multi-cylinder internal combustion engine, wherein said deflecting rib is formed between said intake-valve-port side port wall portion of one of two cylinders which are contiguous with each other in said cylinder head center line direction and said exhaust-valve-port side port wall portion of the other cylinder, and wherein said deflecting rib is connected to a central rib which protrudes upwardly from said bottom wall and extends in said cylinder head center line direction between both end portions of said cylinder head.

5. A cylinder head cooling construction for an internal combustion engine with cylinders and a crankshaft, wherein a coolant jacket through which coolant is allowed to flow is formed by a wall of a cylinder head including bottom walls forming chamber walls of combustion chambers, upper walls, intake port walls forming intake ports having intake valve ports which are opened and closed by intake valves and exhaust port walls forming exhaust ports having exhaust valve ports which are opened and closed by exhaust valves, wherein deflecting ribs are formed in said coolant jacket between intake-valve-port side port wall portions and exhaust-valve-port side port wall portions which are situated downstream of said intake-valve-port side port wall portions in a flow direction of said coolant for directing said flow of coolant toward said exhaust-valve-port side port wall portions, and wherein said deflecting ribs for deflecting part of said flow of coolant which flows in a cylinder head center line direction toward said exhaust-valve-port side port wall portions between said intake-valve-port side port wall portions and said exhaust-valve-port side port wall portions extend downwardly from said upper walls and extend toward said intake-valve-port side port wall portions and said exhaust-valve-port side port wall portions, and said deflecting ribs are formed to leave gaps between lower end portions of said deflecting ribs and said exhaust-valve-port side port wall portions and said bottom walls for allowing said coolant to flow on wall surfaces of said exhaust-valve-port side port wall portions and wall surfaces of said bottom walls.

6. A cylinder head for an internal combustion engine, comprising:

bottom walls forming chamber walls of combustion chambers;

intake port walls forming intake ports having intake valve ports which are opened and closed by intake valves;

exhaust port walls forming exhaust ports having exhaust valve ports which are opened and closed by exhaust valves, so that a coolant jacket through which coolant is allowed to flow is formed by said bottom walls, said intake port walls and said exhaust port walls; and deflecting ribs formed within said coolant jacket between intake-valve-port side port wall portions and exhaust-valve-port side port wall portions of said adjacent combustion chambers which are situated downstream of said intake-valve-port side port wall portions in a flow direction of said coolant, said deflecting ribs being protruded upwardly from said bottom walls, wherein at least one of said deflecting ribs defines a gap in at least one of a first position between said intake-valve-port side port wall portion and said deflection rib, a second position between said exhaust-valve-port side port wall portion and said deflecting rib, and a third position being an intermediate position of said deflecting ribs extending from both of said intake-valve-port side port wall portion and said exhaust-valve-port side port wall portion.

7. The cylinder head as set forth in claim 6, further comprising:

a central rib which protrudes upwardly from said bottom wall and extends in a cylinder head center line direction between both end portions of said cylinder head, wherein said deflecting rib is connected to said central rib.

8. A cylinder head for an internal combustion engine, comprising:

bottom walls forming chamber walls of combustion chambers;

upper walls;

intake port walls forming intake ports having intake valve ports which are opened and closed by intake valves;

exhaust port walls forming exhaust ports having exhaust valve ports which are opened and closed by exhaust valves, so that a coolant jacket through which coolant is allowed to flow is formed by said bottom walls, said upper walls, said intake port walls and said exhaust port walls; and deflecting ribs formed within said coolant jacket between intake-valve-port side port wall portions and exhaust-valve-port side port wall portions of said adjacent combustion chambers which are situated downstream of said intake-valve-port side port wall portions in a flow direction of said coolant, wherein said deflecting ribs extend downwardly from said upper walls and extend toward said intake-valve-port side port wall portions and said exhaust-valve-port side port wall portions, respectively, and further wherein at least one of said deflecting ribs is formed to define a gap between a lower end portion of said deflecting rib and said exhaust-valve-port side port wall portion and said bottom wall.

* * * * *